United States Patent [19]

Durst et al.

[11] Patent Number: 4,999,927

[45] Date of Patent: Mar. 19, 1991

[54] PROCESS AND DEVICE FOR DRYING A LIQUID LAYER APPLIED TO A MOVING CARRIER MATERIAL

[75] Inventors: Franz Durst, Langensendelbach; Raimund Haas, Frankfurt am Main; Guenter Hultzsch, Wiesbaden; Manfred Dammann, Hohenstein; Gerhard Mack, Walluf; Werner Interthal, Ruesselsheim; Joachim Stroszynski, Wiesbaden; Peter Lehmann, Kelkheim, all of Fed. Rep. of Germany

[73] Assignee: Hoechst Aktiengesellschaft, Frankfurt am Main, Fed. Rep. of Germany

[21] Appl. No.: 349,227

[22] Filed: May 9, 1989

[30] Foreign Application Priority Data

May 13, 1988 [DE] Fed. Rep. of Germany ..... 3816414
Jan. 14, 1989 [DE] Fed. Rep. of Germany ..... 3900957

[51] Int. Cl.[5] ..... F26B 3/00

[52] U.S. Cl. ..... 34/23; 34/155; 34/156; 432/59

[58] Field of Search ..... 34/151, 155, 23, 41; 432/59

[56] References Cited

U.S. PATENT DOCUMENTS

| | | | |
|---|---|---|---|
| 2,144,919 | 1/1939 | Gautreau | 34/23 |
| 2,775,046 | 12/1956 | Kabelitz | 34/23 |
| 3,012,335 | 12/1961 | Allander et al. | 34/155 |
| 3,106,460 | 10/1963 | Topham et al. | 34/23 |
| 3,183,604 | 5/1965 | Stauffer | 34/23 |
| 3,183,605 | 5/1965 | Argue et al. | 34/68 |
| 4,589,843 | 5/1986 | Smith | 432/59 |

FOREIGN PATENT DOCUMENTS

| | | |
|---|---|---|
| 1904984 | 11/1964 | Fed. Rep. of Germany . |
| 1555670 | 1/1969 | France . |
| 2461218 | 1/1981 | France . |
| 877266 | 9/1961 | United Kingdom . |
| 1239094 | 7/1971 | United Kingdom . |
| PCT/US82/-00371 | 3/1982 | World Int. Prop. O. . |

OTHER PUBLICATIONS

Martin et al., "Ursachen der Randübertrocknung in Schlitzdüsentrocknern", Chemie Ingenieur Technik, vol. 42, No. 14, 1970, pp. 927–929.

Martin, "Berechnung der Schlitzweite eines Schlitzdüsenfeldes unter der Bedingung konstanten Wärme-und Stoffüberganges in Abströmrichtung", Chemie Ingenieur Technik, vol. 42, No. 8, 1971, pp. 516–519.

Martin et al., "Optimierung von Schlitzdüsentrocknern auf Grund neuer Versuchsergebnisse über den Wärme-und Stoffübergang in solchen Apparaten", Chemie Ingenieur Technik, vol. 45, No. 5, 1973, pp. 290–294.

Kramer et al., "Schwebetrockner für beschichtete Blechbänder", (Heavy-Duty Levitation Dryer in a Modern Strip-Coating Line), Gas Warme International, vol. 24, No. 12, 1975, pp. 527–531.

*Primary Examiner*—Henry A. Bennet

*Attorney, Agent, or Firm*—Foley & Lardner, Schwartz, Jeffery, Schwaab, Mack, Blumenthal & Evans

[57] ABSTRACT

A process for drying a liquid layer which has been applied to a carrier material moving through a drying zone and which contains vaporizable solvent components and non-vaporizable components, wherein a drying gas flows in the longitudinal direction of the carrier material parallel to the liquid layer and is accelerated in the drying zone in the direction of flow, is disclosed. Also disclosed is a device for accomplishing the drying process, comprising a drying channel through which the carrier material bearing the liquid layer runs in the longitudinal direction, and a gas-permeable channel-covering surface, through which the gas stream flows into the drying channel.

39 Claims, 16 Drawing Sheets

FIG.3A
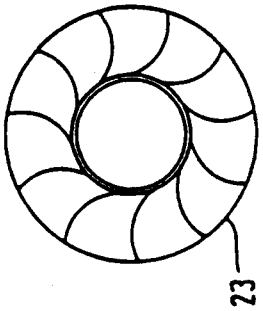
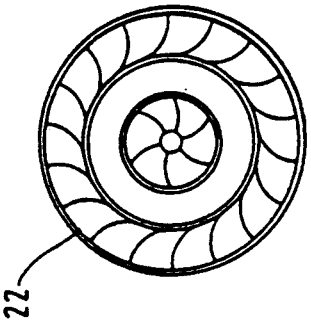
FIG.3B
FIG.3
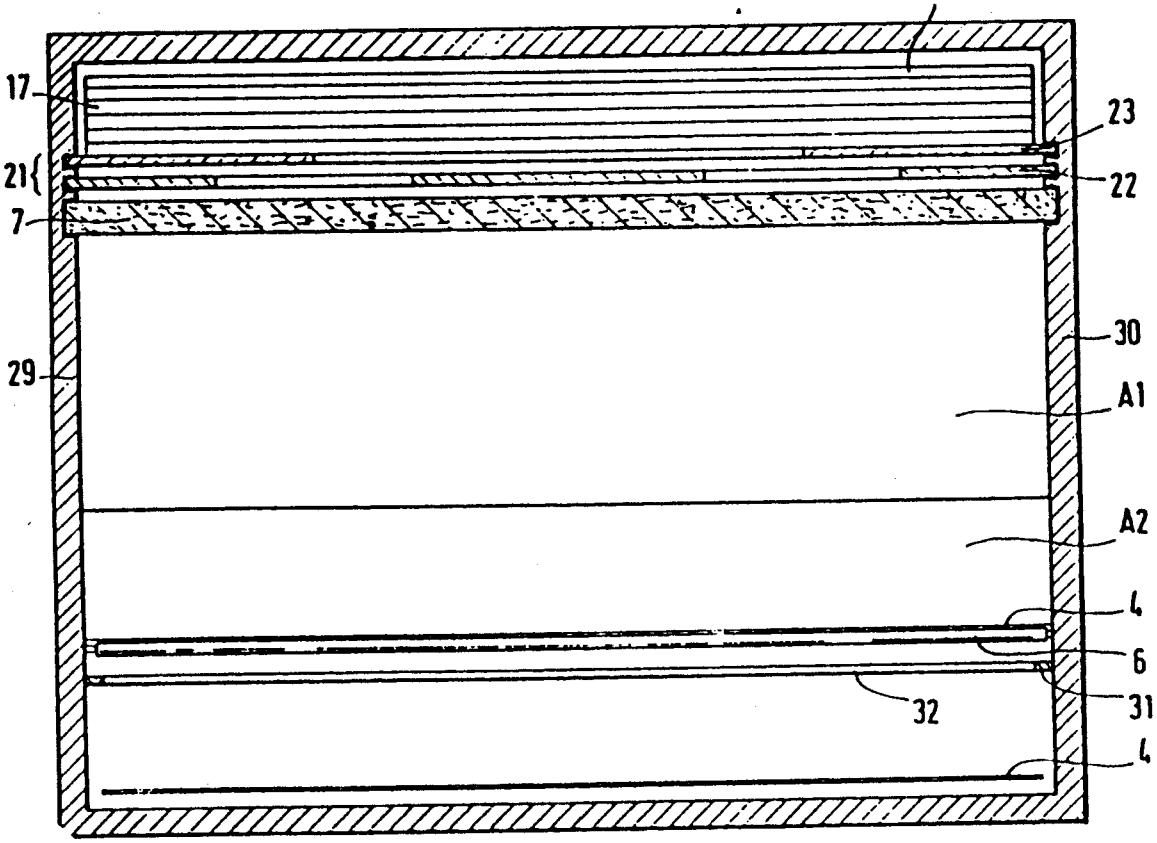

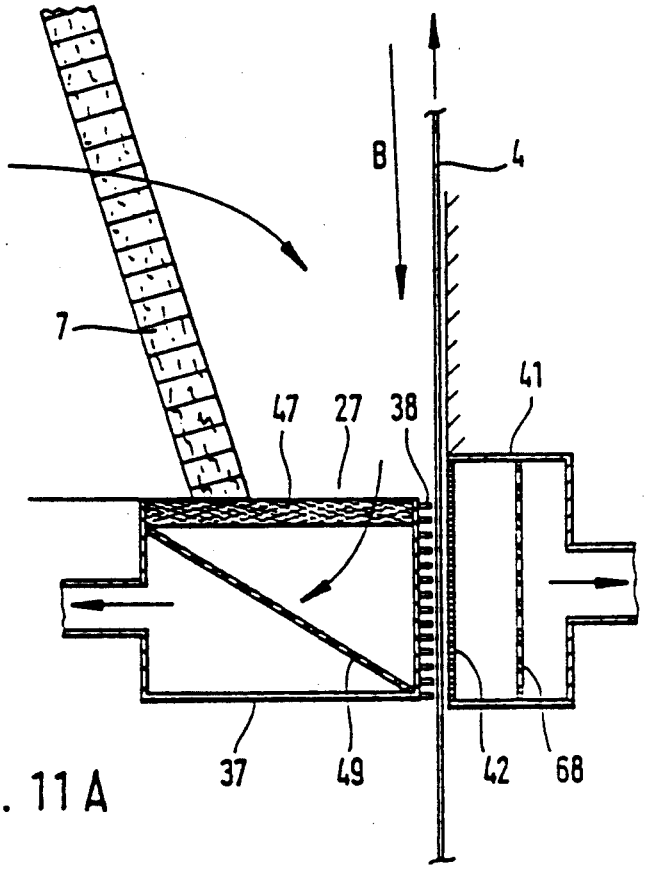
FIG. 11A
FIG. 11B
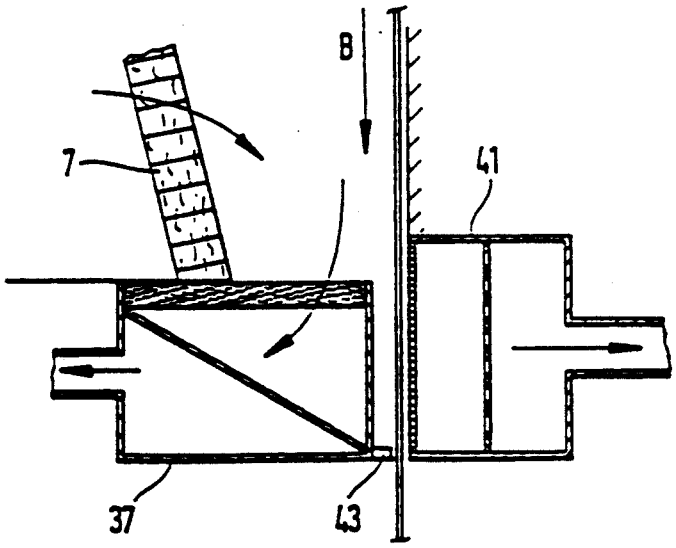

PROCESS AND DEVICE FOR DRYING A LIQUID LAYER APPLIED TO A MOVING CARRIER MATERIAL

BACKGROUND OF THE INVENTION

The invention relates to a process and to a device for drying a liquid layer which has been applied to a carrier material moving through a drying zone and which contains vaporizable solvent components and non-vaporizable components.

Diverse drying processes and drying devices are used in the drying of large-area web-shaped goods to which liquid layers have been applied. Examples of typical goods to be dried are metal strips or plastic strips, to which liquid layers have been applied which, as a rule, are composed of vaporizable solvent components which are removed from the liquid film during the drying process, and of nonvaporizable components which remain on the carrier material after drying.

As a result of the coating, the surfaces of the carrier materials are provided with special properties, which only after the drying process are in the form which is desired for the later use. As an example of this, the coating of metal strips with light-sensitive layers may be mentioned, which are made up to give printing plates. The coating of metal strips or plastic films with substances in the form of a solvent-containing wet film, called liquid film in the text which follows, and the subsequent drying of the film thus represent a process which requires special installations in order to ensure the desired product quality of the layers. The essential point here is the process step of film drying, as the final process measure of coating.

In the drying of liquid films on carrier materials, it is usual to cause a heated gas, in particular air, to flow over the surface of the carrier materials in order to remove the solvent components from the film layer. The heated gas stream is here brought into direct contact with the liquid film, which has been applied in a uniform coating distribution to the carrier material which runs through a drying device. In order to ensure a streak-free and mottle-free dried film surface, i.e., a uniform distribution of the remaining components, the drying installations are fitted with devices which are intended to effect a favorable and/or uniform distribution of the air flow over the liquid film. This is intended to provide uniform drying across the entire width of the coated web. Furthermore, known drying installations have devices for minimizing disturbances in the air movements, which have an adverse effect on the film surface, partially due to turbulent flow movements, and cause mottling phenomena thereon.

A conventional construction of such a drying device comprises, according to U.S. Pat. No. 3,012,335, supplying, as uniformly as possible, the gas space directly above the liquid film which is to be dried with drier gas from a gas space, which is located along a certain length above the coating web, and which is supplied therewith, by means of a multiplicity of slots, nozzles, holes or porous solids. The continuously coated strip or coated plates on a revolving transport belt are here passed through the drying device continuously and with release of solvent vapor to the drier air. The drier air fed in can here be continuously renewed in open circulation or the air enriched with solvent can be discharged completely. A circulating-air process with partially renewed or discharged drier air can also be used.

Difficulties in the discharge of the drier air from the drying space are frequently caused by the fact that, in the case of longitudinal nozzles arranged transversely to the direction of running of the strip, or of longitudinal slots, a reduction in the nozzle outlet velocity occurs in the middle of the field, due to the pressure gradient in the case of lateral outflow, and hence the heat transfer and mass transfer transversely to the direction of running of the strip are also affected. The consequence thereof is overdrying of the edge, which causes undesired structuring of the dried films in many coating processes.

In the technical journal "Chemie-Ingenieur-Technik", Volume 42, No. 4 (1970), pages 927 to 929, Volume 43, No. 8 (1971), pages 516 to 519, and Volume 45, No. 5 (1973), pages 290 to 294, proposals are therefore made for optimizing the constructional design of nozzle fields in slot nozzle driers, which are intended to ensure constant heat transfer and mass transfer across the entire strip width of a drier. For optimizing slot nozzle driers, mass transfer measurements in impingement flow from slot nozzle fields with differing nozzle areas are empirically correlated within a wide range of the external parameters. The correlation found is used for determining optimum nozzle geometries with respect to the fan output per $m^2$ of goods surface area. It is found here that a constant heat transfer and mass transfer across the strip width is achieved when the nozzle slots have slot widths which continuously increase from the strip edge towards the middle.

When large-area goods webs are dried, a high uniformity of the heat transfer and mass transfer across the strip width must frequently be demanded in order to avoid local overdrying and the associated reduction in quality. In these cases, slot nozzle fields are preferably used in which the slots are arranged transversely to the direction of running of the web. The edge overdrying observed here in the slot nozzle driers with outflow in the nozzle direction is to be ascribed to the distribution of the outlet velocity along the slots. In order to avoid this edge overdrying, it follows from this for nozzle driers, inter alia, that the outflow area should, as far as possible, be 3.5 times the nozzle outlet area, in order to obtain uniform drying across the width of the goods web.

It is now state of the art to carry out a contactless surface treatment in suspension driers for film strips or metal strips by means of a carrier air nozzle system (Journal "Gas Waerme International", Volume 24 (1975), No. 12, pages 527 to 531). The drier air enriched with solvent is here exhausted again directly in the nozzle fields, in order to eliminate the undesired transverse flow. This results in so-called nozzle driers or impingement jet driers, wherein above all the stagnation point-like flow of individual nozzles is a disadvantage, which tends, both in the laminar and the turbulent form of flow, to gas flow instabilities which inevitably lead to irreversible drying structures, particularly in the case of low-viscosity liquid films.

To avoid stagnation point-like flows in the initial region of the drier apparatus, the drier air is, according to PCT Application W082/03450, passed from an upstream chamber via suitable inlet orifices and flow baffles into a quietened intermediate chamber, from where a part of the drier air reaches the web, which is to be dried, via a porous filter element arranged in the immediate vicinity of the liquid film. The mode of action of such drying is based on the fact that, between the porous protective shield and the liquid film which is to be dried, a weak air flow is formed which is quietened but highly enriched in solvent and which is continuously renewed by exchange with the residual air flowing off transversely via the porous medium, so that, due to the relatively short overall length, pre-drying of the liquid film with a reduced tendency to mottling phenomena is achieved.

This type of drying is distinguished by predominant diffusion of the solvent vapor/air mixture through the porous protective shield, whereby complete drying-out of the liquid film becomes possible, in the almost complete absence of convective removal within the space between the strip and the protective shield only in the case of very great drier lengths or with the addition of down-stream auxiliary driers.

A particular disadvantage of the drying devices hitherto used is that, due to the solvent-laden air flows within the drying chamber, a sealing device compatible with the external atmosphere must be provided. Depending on the magnitude of the absolute pressure within the drier chamber directly above the liquid film, either, under vacuum conditions, a part of the required fresh air flows inwards via the finite sealing gap or, under positive pressure conditions, a part of the solvent-laden air flows outwards, and irreversible structures can be produced on the undried liquid film by the flow in the sealing gap.

SUMMARY OF THE INVENTION

Accordingly, it is an object of the present invention to provide a continuous process for drying liquid layers applied to carrier materials, without formation of surface structures which interfere with the uniform distribution of the dried film layer and might impair its desired properties.

Another object of the present invention is to provide a device by means of which the abovedescribed drying process can be accomplished.

In accomplishing the foregoing objectives, there has been provided, in accordance with one aspect of the present invention, a process for drying a liquid layer which has been applied to a carrier material moving through a drier comprising a drying zone and which contains vaporizable solvent components and nonvaporizable components, wherein a gas flows in the longitudinal direction of the carrier material parallel to the liquid layer and is accelerated within the drying zone in the direction of flow.

In accordance with another aspect of the present invention there is provided a device for accomplishing the above-described process, which comprises a drying channel through which the carrier material runs in the longitudinal direction, and a channel-covering surface through which a stream of drying gas flows into the drying channel, wherein the channel-covering surface is gas-permeable, the permeability of the surface being adjustable in the longitudinal direction of the drying channel.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention is explained below in more detail by reference to diagrammatically illustrated embodiment examples, in which:

FIGS. 3, 3A and 3B shows a section along the line I—I of the drying device according to FIG. 2, FIGS. 4A and 4B each show a perspective view of a drying channel of trumpet-like geometry, which can be used, in place of the drying channel having a rectangular cross-section, in the embodiments according to FIGS. 1 to 3, 9 and 10, FIGS. 11A and 11B show a diagrammatic detail in the region of the channel inlet of a drying device in which the carrier material is passed along under vacuum, and a diagrammatic sectional view in the region of the channel inlet in an embodiment slightly modified as compared with FIG. 11A.

DETAILED DESCRIPTION OF THE PREFERRED EMBODIMENTS

Figure 1:
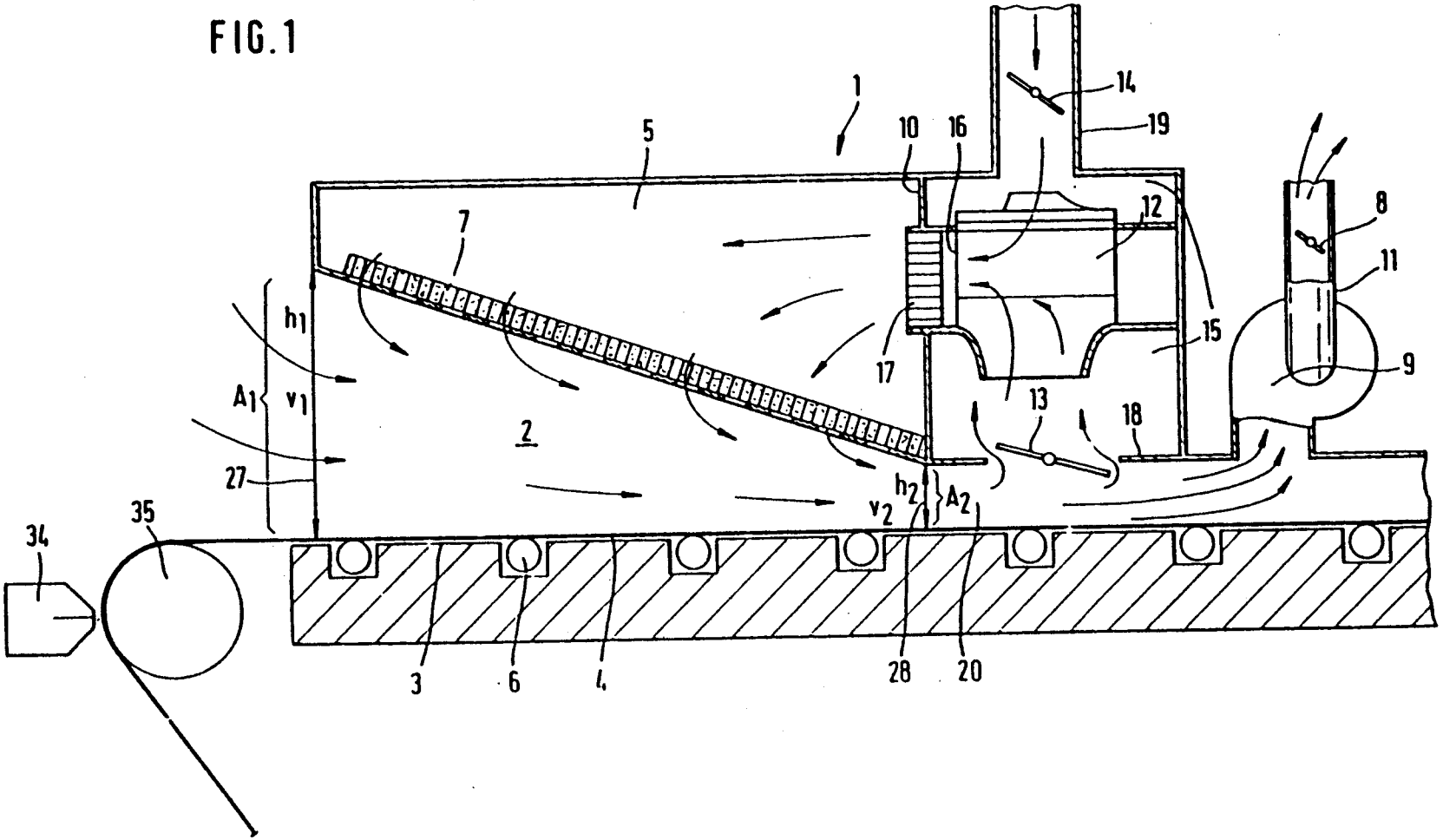
FIG. 1 shows a diagrammatic sectional view of a first embodiment of the drying device according to the invention.

In developing the process, the initial velocity $v_1$ of the gas flow is increased to a final velocity $v_2$ which amounts to up to 1000 times the initial velocity $v_1$. The velocity distribution of the gas flow in the individual cross-sections of the drying zone transversely to the direction of running of the carrier material is here adjusted to be constant.

In developing the process, the gas has been heated and the total gas stream is exhausted at one end of the drying zone. Expediently, the drying zone is designed in such a way that disturbances arising in the inlet cross-section and in the drying zone, such as eddies and turbulence in the gas flow, are damped by the accelerated gas flow and become laminar. The process is applied here either in such a way that the flow through the drying zone takes place at a constant volumetric gas flow rate, the cross-section of the drying zone steadily decreasing in the direction of running of the carrier material, or in such a way that the volumetric gas flow rate is steadily increased in the direction of running of the carrier material, at constant cross-section of the drying zone or also at decreasing cross-section of the drying zone.

In the process, the gas flow turbulence introduced into the drying zone is directly damped by the gas flow locally accelerated in the direction of flow, and largely laminar flow is obtained.

In a further development of the process, the carrier material runs vertically through the drying zone and one side of the carrier material carries a liquid layer which is dried.

It is equally possible that the carrier material is provided on both sides with liquid layers and both sides of the carrier material are dried by drying gas which flows in the direction opposite to the vertical direction of running of the carrier material. The carrier material can also, with a liquid layer applied to its underside, run horizontally or obliquely through the drying zone, the drying gas flowing underneath the carrier material along the suspended liquid layer.

The process is here carried out either in such a way that the flow through the drying zone takes place at a constant volumetric gas flow, the crosssection of the drying zone continuously decreasing against the direction of running of the carrier material, or in such a way that the volumetric gas flow is continuously increased against the direction of running of the carrier material, at constant cross-section of the drying zone or also at constantly reducing cross-section of the drying zone.

In the process, for example, the carrier material enters the drying zone at the bottom through the drier inlet and leaves the drying zone at the top through the drier outlet, and the downward-directed total gas stream is exhausted near to the drier inlet.

A device for drying a liquid layer which has been applied to a moving carrier material and contains vaporizable solvent components and nonvaporizable components, having a drying channel through which the carrier material runs in the longitudinal direction, and having a channel-covering surface through which a drying gas stream flows into the drying channel, is defined by a channel-covering surface which is designed as a gaspermeable surface, the permeability of the surface for the drying gas stream being adjustable in the longitudinal direction of the drying channel.

In a further development of this device, the channel-covering surface is inclined relative to the channel base surface which extends horizontally, the channel inlet height of the drying channel being greater than the channel outlet height.

In another preferred embodiment of the device, the channel-covering surface is inclined relative to the channel base surface which extends vertically, the channel inlet width of the drying channel being smaller than the channel outlet width. In this case, the channel inlet is that region in which the coated material runs into the channel.

The invention has the advantages that, by means of relatively simple construction measures which effect a defined gas flow pattern in the drying channel, the desired disturbance-free drying of lowviscosity and high-viscosity liquid layers on carrier materials is achieved. The mean velocity of the gas flow is here increased from an inlet velocity $v_1$ along the length of the drying channel to an outlet velocity $v_2$ which is substantially greater than $v_1$. The velocity distribution is here adjusted to be constant in an individual drying channel crosssection, and the geometry of the drying channel is designed such that the gas disturbances arising in the inlet cross-section and in the drying channel are damped out by the gas acceleration and that the total air stream necessary for drying is exhausted at the end of the drying channel.

At the channel inlet, where the liquid layer is most sensitive to being blown about, the gas flow is laminar. The high flow velocity in the channel in that region here leads to rapid removal of the solvents. The liquid layer dries on particularly quickly and is then stable to turbulent flows which can arise at the widened channel outlet. In the case of vertical upward running of the carrier material strip, the heavy solvent vapors are discharged by the counter-flow gas stream in the direction of gravity and not opposite thereto.

An inlet zone with quietened flow does not have to be provided, and it is immaterial whether turbulence does or does not arise in the region of low flow velocities at the wide channel outlet, since the layer has already dried on at the latter. The gas flow can be greatly accelerated and the drier length can thus be shortened. The heat transfer in the drying zone is determined, inter alia, by the gas velocity. In the case of gas flow in the same direction, strip heating and hence drying takes place nearer to the channel outlet, and in the case of gas flow in the opposite direction it takes place nearer to the channel inlet of the drying zone.

Referring to the drawings, FIG. 1 shows, in a diagrammatic sectional view, a first embodiment of a drying device 1 according to the invention. A strip 4 of carrier material, for example a metal strip of aluminum or a film strip, runs past a slot coater 34, which applies to the strip 4 of carrier material a liquid layer which contains vaporizable solvent components and nonvaporizable components. The strip 4 of carrier material is conveyed around a deflection roller 35 and runs through a channel inlet 27, having an inlet cross-section Al, into a drying channel 2. The strip 4 of carrier material here runs, in the drying channel 2 and in a passage channel 20 adjoining the drying channel 2, on support rollers 6 which are sunk in the horizontal channel base surface 3 or let into the channel bottom. The drying device 1 can also be designed as a drier in which the strip 4 of carrier material is passed through the drying channel 2 in free suspension by means of air carrier nozzles and the carrier air is discharged laterally.

A channel-covering surface 7 is designed as a gas-permeable surface which is inclined relative to the channel base surface 3 extending horizontally, the channel inlet height h1 of the channel inlet 27 of the drying channel 2 being greater than the channel outlet height h2 of the channel outlet 28 which has an outlet cross-section A2. The channel-covering surface 7 is inclined relative to the horizontal channel base surface 3 by, for example, an angle equal to 3.9', the permeable channel-covering surface extending over the entire length of the drying channel 2, starting at the channel inlet 27.

Above the drying channel 2, there is a drying chamber 5 which is separated from a gas exchange chamber 15 by a partition 10. In the gas exchange chamber 15, there is a fan 12 or a ventilator, the fan outlet 16 of which is directed towards a heat exchanger 17 in the partition 10. In a bottom surface 18 of the gas exchange chamber 15, there is an opening in which a damper device, for example a throttle flap 13, is located which is adjustable about a horizontal axis. The gas exchange chamber 15 has a gas inlet 19 which adjoins the covering surface of the gas exchange chamber 15 and contains a throttle flap 14 as the damper device. The damper device can also comprise, inter alia, two mutually displaceable orifice plates or a lamella shutter device.

The fan 12 is a double-flow circulation fan with return blades, the fresh gas stream added from the gas inlet 19 to the return blades being delivered into the drying chamber 5.

The passage channel 20 adjoining the drying channel 2 has a constant cross-section corresponding to the channel outlet cross-section A2 of the drying channel. The underside of the bottom surface 18 of the gas exchange chamber 15 is also the covering surface of the passage channel. Above the covering surface of the passage channel, downstream of the gas exchange chamber 15, there is a ventilator or suction fan 9, the suction orifice of which is located in the covering surface of the passage channel. A throttle flap 8 is located in an outlet 11 of the suction fan 9.

The channel-covering surface 7 comprises, for example, a continuous filter of constant permeability.

Figure 2:
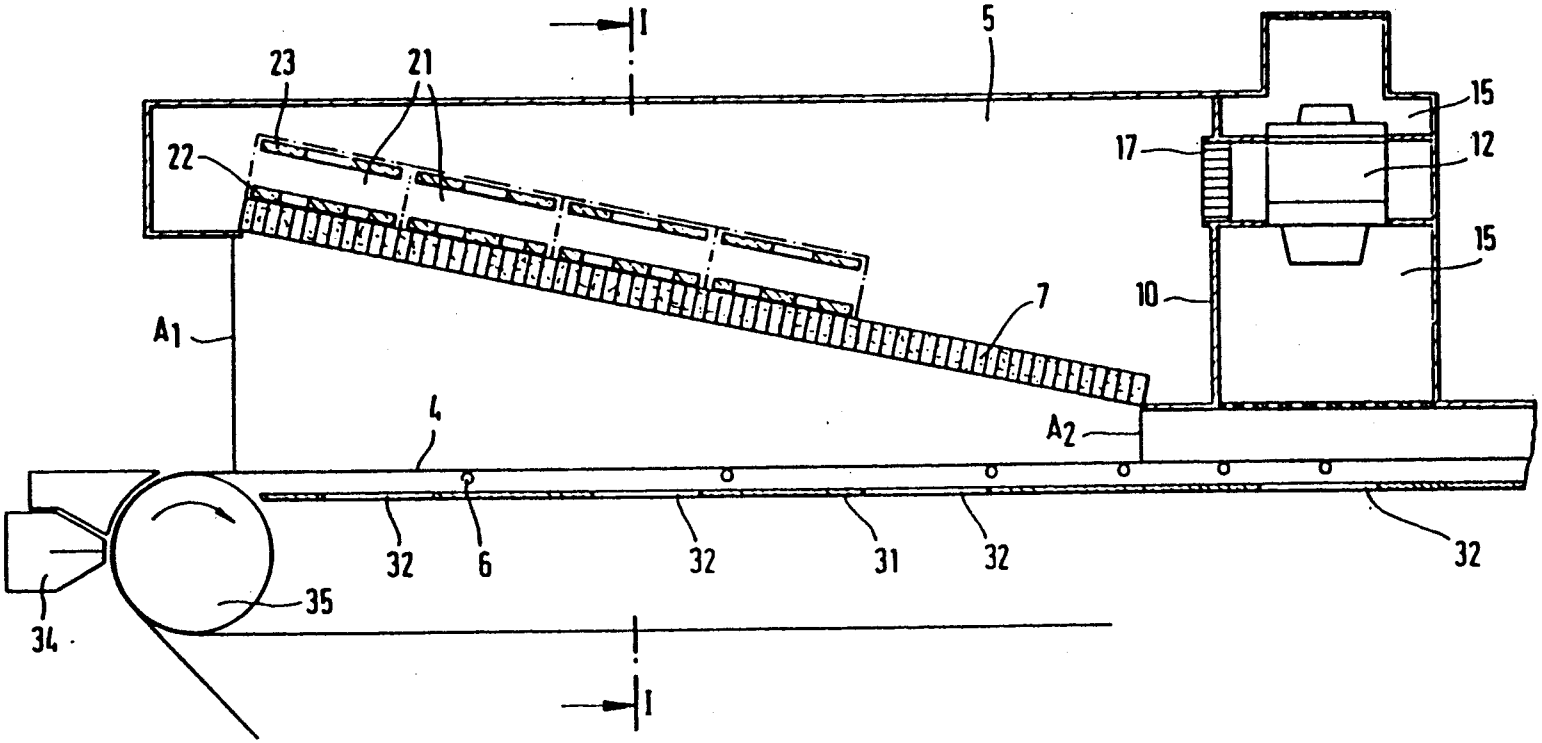
FIG. 2 shows a diagrammatic sectional view of a second embodiment of the drying device according to the invention, with a narrowing drying channel having a rectangular cross-section.

FIG. 2 shows a diagrammatic sectional view of a second embodiment of the drying device 1 according to the invention, which, as distinct from the first embodiment, has, on the upper side of the channel-covering surface 7, additional feeding devices 21 for the gas to be added. The gas is in general heated air. The drying channel 2 is designed similarly to the drying channel of the first embodiment, with a horizontal channel base surface 3 and a channel-covering surface 7 inclined relative thereto. The gas or air flow in the inlet cross-section $A_1$ of the channel inlet has an inlet velocity $v_1$ approaching zero, while the outlet velocity $v_2$ in the outlet cross-section $A_2$ of the channel outlet 22 can be up to 75 m/second. For the sake of clarity, the suction fan marked in FIG. 1 by the reference numeral 9 is not shown in FIG. 2, even though it is present in the same way as in the first embodiment example.

The feeding devices 21 comprise boxes having two mutually displaceable orifice plates 22, 23, the opening cross-sections of which are adjustable. These orifice plates 22, 23 are either located directly above one another or, as shown, are mutually spaced. Depending on the setting of the opening crosssections of the orifice plates 22, 23, (compare FIGS. 3A and 3B), different permeabilities of the individual boxes of the feeding devices 21 result, so that different air rates flow, sectionally corresponding to the lengths of the boxes, through the channel-covering surface 7. It is thus possible to control the gas or air rate flowing into the drying channel 2 in different ways along the lengths of the drying channel 2, in addition to the varying gas rate distribution which is established without the feeding devices.

Above the strip 4 of carrier material in the gas exchange chamber 15, there is, for example, a vacuum of 3.35 mbar as compared with atmospheric pressure, while there is a positive pressure of 1.4 mbar at the fan outlet of the fan 12. In the drying chamber 5 above the feeding devices 21, the positive pressure is about 1.1 mbar.

The bottom surface 31 of the drying device has a plurality of openings 32, one of which is opposite the gas exchange chamber 15 and is under the same suction pressure or vacuum as that prevailing in the gas exchange chamber. This ensures that the carrier strip material 4 passing through the drying channel 2 on support rollers 6 is under the same vacuum on both sides, so that lifting-off of the strip 4 of carrier material, such as normally occurs in the direction of the gas exchange chamber 15 if a vacuum is present only in the latter, is prevented.

The remaining openings 32, which can also be located in the side walls, just above the bottom surface, allow exhaustion of the gas layers present in the immediate vicinity of the side walls.

As can be seen from FIG. 3, which shows a section along the line I—I of the drying device 1 according to FIG. 2, the cross-section of the drying channel is rectangular, the channel height decreasing linearly in the direction of the channel outlet cross-section $A_2$. The channel-covering surface 7 and the feeding devices 21 area, for example, let into the side walls 29, 30 of the drying channel 2. One of the openings 32 can be seen in the bottom surface 31.

Figure 4A:
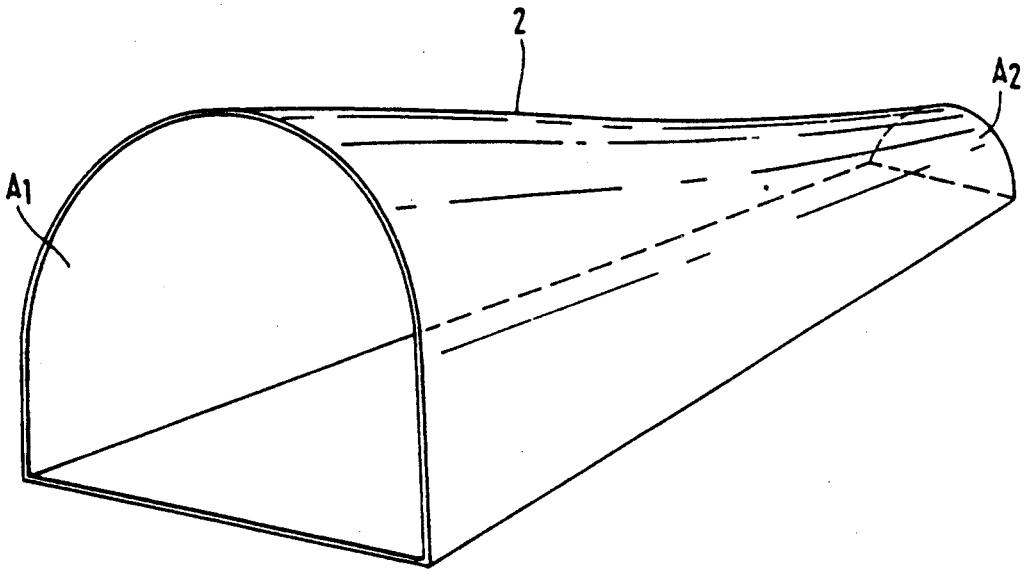
Figure 4B:
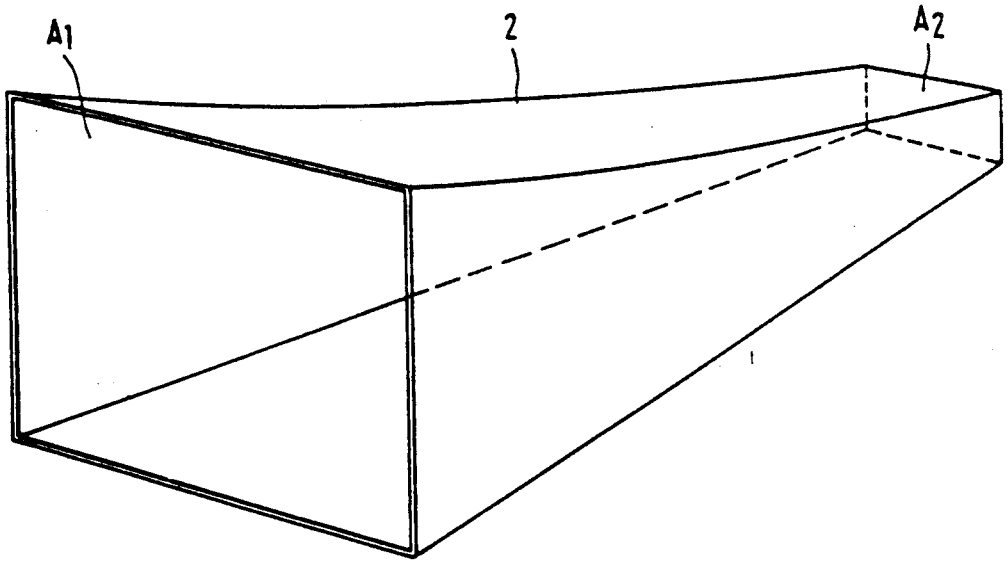

FIGS. 4A and 4B each perspectively show a drying channel 2 which has a trumpet-shaped geometry tapering in the longitudinal direction from the channel inlet to the channel outlet. A drying channel of this type can be used in the embodiment examples according to FIGS. 1 to 3, 9 and 10, in place of the drying channels shown there. The tapering trumpet-shaped geometry of the drying channels ensures that an acceleration of the air or gas stream in the direction of flow takes place. The drying channel according to FIG. 4A has a curved covering surface and curved side walls, whereas the drying channel according to FIG. 4B has a rectangular cross-section, that is to say it has side walls aligned perpendicular to the bottom surface, but a curved covering surface.

The acceleration of the flow in the drying channel can be achieved by means of two different modes of operation or also by a combination of these two modes of operation. In the first mode of operation, a constant volumetric air stream flows through the drying channel 2 and is present in all cross-sections of the drying channel, the crosssections of the drying channel decreasing steadily in the direction of running of the strip from the inlet cross-section $A_1$ to the outlet cross-section $A_2$. The length-dependent decrease in the channel crosssection is made in such a way that disturbances introduced into the flow are damped out and the flow thus becomes laminar. This is effected in such a way that, for example, the volumetric gas or air stream required for drying is drawn in by the suction fan 9 or ventilator, with the damper devices 13 and 14 of the first embodiment according to FIG. 1 closed, at the inlet velocity $v_1$ via the channel inlet 27 having the inlet cross-section $A_1$ and is accelerated via the channel-covering surface 7 inclined in the direction of running of strip to the outlet velocity $v_2$ at the channel outlet 28 having the outlet crosssection $A_2$. The adjustment to an adequate volumetric air flow is here made by controlling the speed of rotation of the suction fan 9 or ventilator and, in the case of a mode of operation independent of the speed of rotation, by adjusting the throttle flap 8 in the outlet 11 of the suction fan 9.

In the second mode of operation, the addition of the volumetric gas or air stream required for drying is made via suitable feeding devices which are fitted in or above the channel-covering surface. The volumetric gas or air stream in the drying channel is here steadily increased in the direction of running of the strip or adjusted in such a way that disturbances are damped out and the gas or air stream is transformed into a laminar flow. For this purpose, in the embodiments of the invention as shown in FIGS. 1 to 5B, the embodiments according to FIGS. 5A and 5B being described in more detail below, the volumetric gas or air stream required for drying is delivered into the drying chamber 5 via the fan 12 or the circulation fan with return blades, with the throttle flaps 13 and 14 open. From the drying chamber 5, the air or gas rate flows via the feeding devices and the channel-covering surface 7 into the drying channel 2 and is accelerated in the latter to the outlet velocity $v_2$ in the outlet cross-section $A_2$. The fan 9 or the ventilator is here adjusted such that only the gas added via the return blades of the fan 12 or the circulation ventilator is exhausted from the drying chamber 5 and the remaining gas rate is continuously circulated. The result is that there is almost no flow or only a very small flow in the inlet cross-section $A_1$.

Figure 12A:
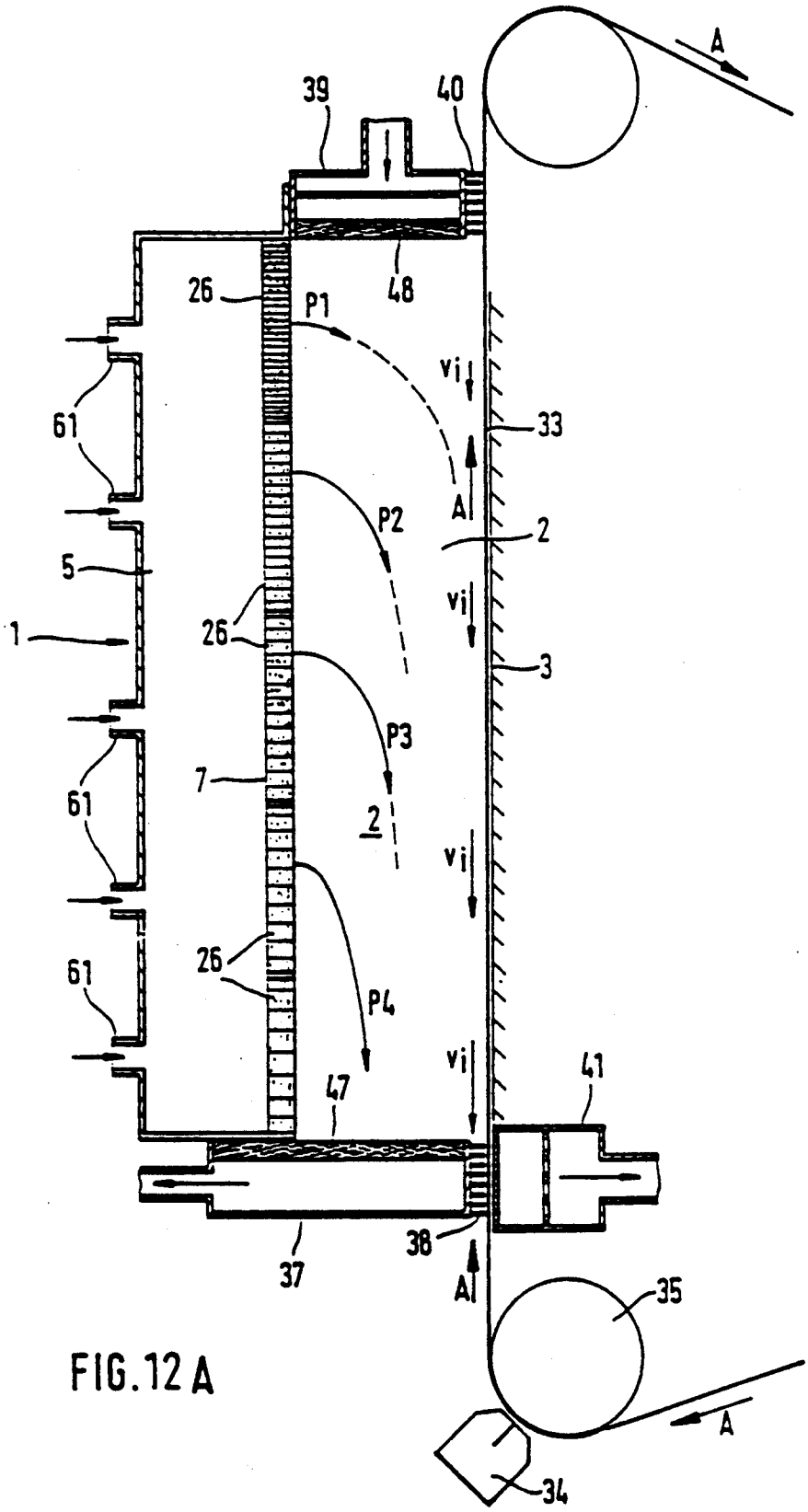
FIG. 12A shows a sectional view of an eighth embodiment of the drying device according to the invention with variable permeability of the covering surface.
Figure 12B:
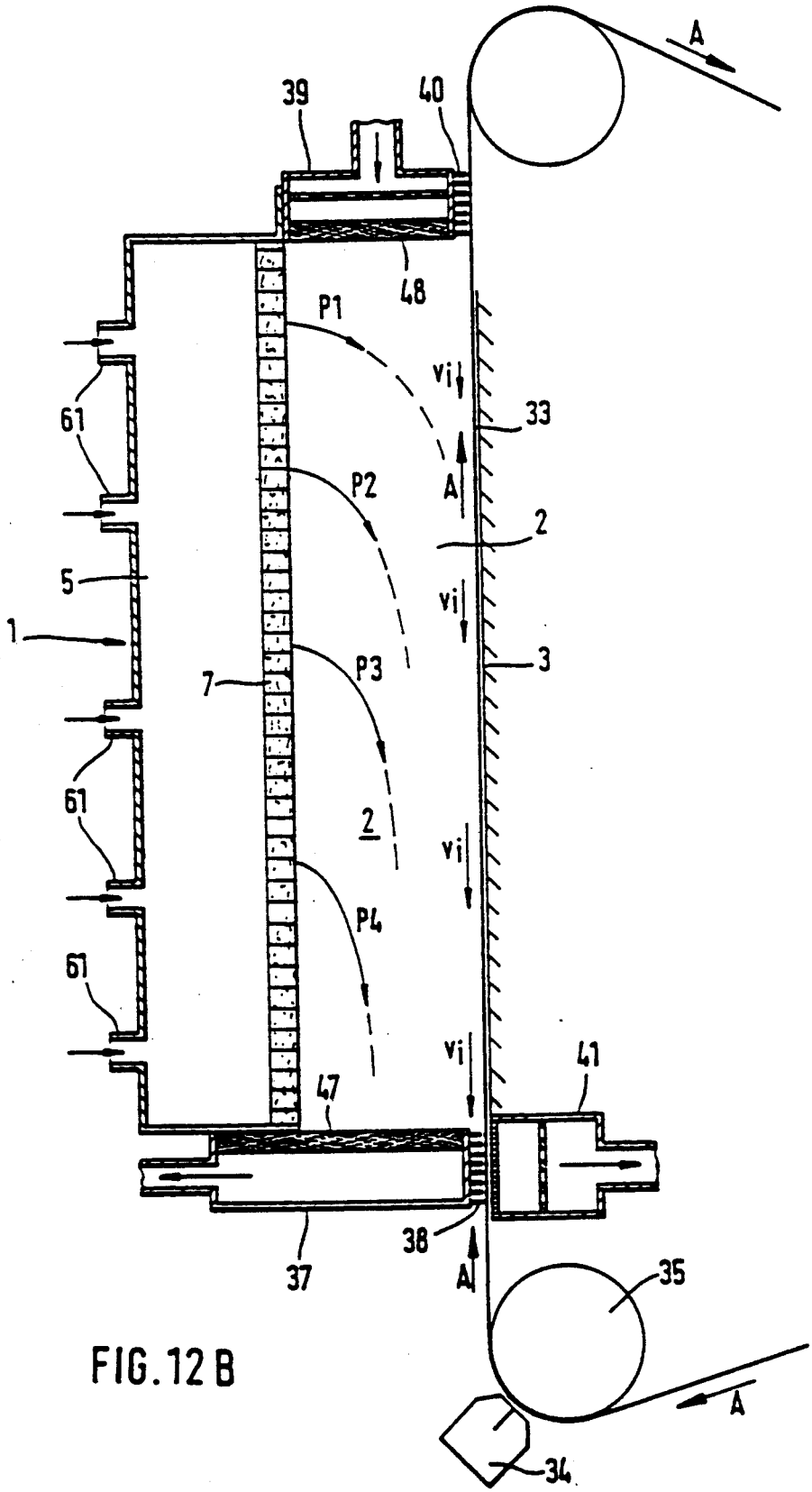
FIG. 12B shows a sectional view of a ninth embodiment of the invention, similar to FIG. 12A, with constant permeability of the covering surface.

In the embodiments of the invention as shown in FIGS. 9 to 12B, the embodiments according to FIGS. 12A and 12B being described in more detail below, the volumetric gas or air stream required for drying is delivered via the feeding devices and channel-covering surface 7 and/or the channel outlet 28 into the drying channel 2 and accelerated in the latter to the outlet velocity in the channel inlet cross-section.

The result is that the maximum velocity along the length of the drying channel occurs in the channel inlet cross-section.

In the first mode of operation of the embodiments according to FIGS. 1 to 5B, for optimum operation the inlet cross-section $A_1$ is, designed so large, or the initial velocity $v_1$ is kept so small, that no initial disturbance effects whatsoever in the form of mottling or large-area blow marks occur on the liquid film which is to be dried.

In the simplest operating case, the coated strip 4 of carrier material is guided in the immediate vicinity of the horizontal channel base surface 3, and the flow acceleration is induced by the channelcovering surface 7, which is inclined in a straight line in the direction of flow. The shape of the channel cross-section is rectangular, and the channel height decreases linearly from the channel inlet height h1 to the channel outlet height h2. The same effect is achieved, for example, with the trumpetshaped geometries of the drying channel 2, shown in FIGS. 4A and 4B. In addition, other channel geometries are also possible, as long as these induce an acceleration required in the direction of flow.

In the first mode of operation according to the embodiments of FIGS. 9 to 12B, the coated strip 4 of carrier material is guided in the immediate vicinity of the vertical channel base surface 3, and the flow acceleration is induced by the channelcovering surface 7 which converges in the direction of flow towards the channel base surface. The shape of the channel cross-section is rectangular, and the channel width decreases linearly from the channel outlet width b2 to the channel inlet width b1. The same effect is achieved, for example, with the trumpet-shaped geometries of the drying channel 2, shown in FIGS. 4A and 4B. In addition, other channel geometries are also possible, as long as these induce an acceleration required in the direction of flow.

In the second mode of operation, particularly good drying results are obtained if, in the case of rectangular channel cross-section, the channel-covering surface 7 extending horizontally or vertically is designed as a continuous, gas-permeable filter. In the case of constant channel cross-section along the length of the drying channel, that is to say in other words in the case of a channel-covering surface extending horizontally or vertically and parallel to the channel base surface, the desired acceleration of the flow results automatically, with constant filter permeability along the drying channel, because of the increasing gas mass flow, and this can also be controlled additionally by the varying permeability of the continuous filter. The channel-covering surface 7 does not have to comprise a continuous filter but can, rather, also comprise lined-up filter mats 26 of the same thickness (compare FIGS. 5A and 12A) of different permeability. The latter can also be achieved by the filter mats having the same consistency or the same structure, but different thicknesses. Another possibility is to design the filter mats with the same thickness but different structure or different consistency.

In the case of an inclined channel-covering surface 7, the gas mass flow and hence the flow acceleration are determined by the inclination of the channel-covering surface. If the inclined channel-covering surface 7 comprises a continuous filter or filter mats, these have advantageously a uniform structure or uniform consistency and hence a constant permeability along the length of the drying channel 2.

The combined application of the first and second modes of operation has advantages above all whenever solvent vapors already released during the coating, which is carried out by means of the slot coater 34 as a rule imediately before the drying device 1, must be exhausted.

The accelerated flow evidently contributes, both in the first and in the second mode of operation, in several ways to rapid drying of the liquid layer and to a structure-free surface quality of the coated strips of carrier material. Investigations which have been carried out show that macroscopic flow turbulence caused, for example, by the feed points of the gas or air stream are damped in the drying channel 2, with correct adjustment of the first or second mode of operation, in such a way that disturbances of the drying process immediately downstream of the feed points no longer occur, that it is to say the flow already becomes laminar in the immediate vicinity of the place where turbulence arises. Observations show that this is the forced result of the induced acceleration of the turbulent regions of the gas or air flow with simultaneous longitudinal alignment or longitudinal deformation of these turbulent regions.

In the vicinity of the strip, the accelerated gas or air flow proceeds parallel to the strip of carrier material in the same direction as the direction of running thereof or opposite thereto, so that, as a result of the gas/air flow becoming increasingly faster relative to the liquid film and the boundary layer flow thereof, the diffusion paths of the vaporizing solvent are kept small in the vicinity of the liquid film, thus allowing high heat transfer and mass transfer from the liquid layer to the drying medium at a high end velocity of the gas/air flow, but a small length of the drying channel.

In a convergent drying channel, with downward air flow in the direction opposite to the direction of running of the strip, layers without blow marks are produced, the air flow and the solvent vapors following gravity.

The constant velocity of the flow, applying across the width of the liquid-coated strip 4 of carrier material which is to be dried, results in very uniform drying of the liquid film transversely to the direction of running of the web. This means that the velocity distribution of the gas/air flow in the individual cross-sections of the drying zone or drying channel must be kept constant transversely to the direction of running of the strip of carrier material.

Figure 5A:
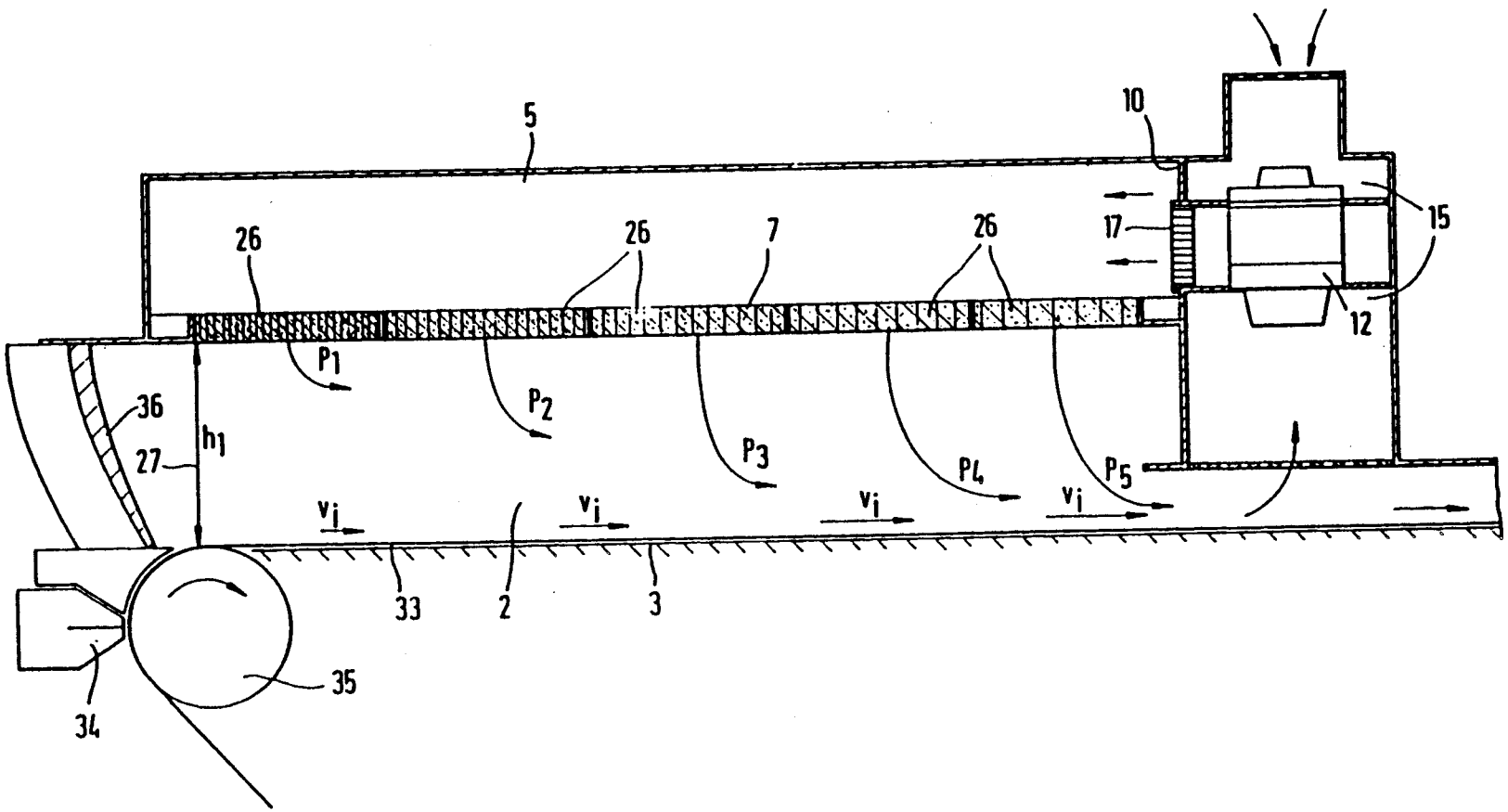
FIG. 5A shows a sectional view of a third embodiment of the drying device with variable permeability of the covering surface, partially broken open, according to the invention.

FIG. 5A shows a diagrammatic sectional view of a third embodiment of the drying device 1, in which the drying channel 2 has a horizontally extending channel-covering surface 7 which runs parallel to the channel base surface 3. The horizontal channel-covering surface 7 comprises lined-up filter mats 26 which are of the same thickness and have different permeabilities for gas or air. In FIG. 5A, the differing permeability is indicated by different density of the hatchings of the individual filter mats 26, in such a way that the filter mat nearest the channel inlet is hatched more densely, corresponding to its lower permeability, and the hatchings of the filter mats 26 decrease in the direction of the channel outlet, in order to indicate that the permeability of the filter mats increases in the direction of running of the strip 33 of carrier material. The other components of the drying device, which are the same as the components in the first and second embodiments of the drying device, are provided with the same reference numerals as in FIGS. 1 to 3. In front of the channel inlet 27 of the drying channel 2, there is a sealing mat 36. The channel cross-sections are constant along the length of the drying channel 2. Because of the different permeabilities of the filter mats 26, a different gas/air rate flows through each individual filter mat 26, which is indicated by the size of the bent arrows $P_1$ to $P_5$ allocated to the individual filter mats 26. The increase in the gas/air rate fed, in the direction of the channel outlet, results in an acceleration of the flow in the direction of running of the strip 33 of carrier material. This acceleration or this increase in velocity of the flow towards the channel outlet is indicated by the increasing size of the velocity arrows $v_i$, which are drawn parallel to the strip 33 of carrier material.

Figure 5B:
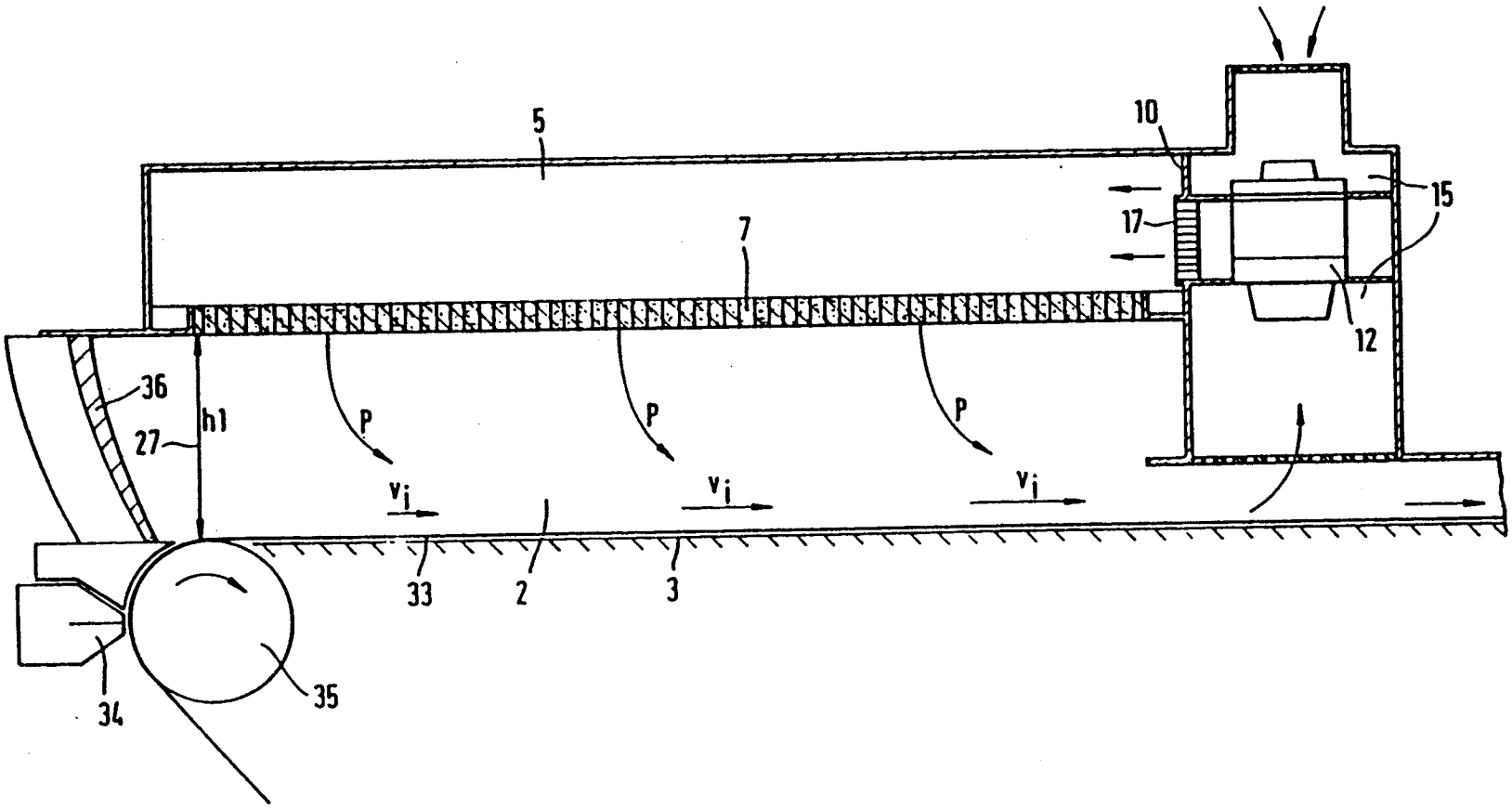
FIG. 5B shows a sectional view of a fourth embodiment of the invention, similar to FIG. 5A, with constant permeability of the covering surface.

The fourth embodiment, shown in FIG. 5B, is the same as the third embodiment, with the exception of the covering surface. The covering surface 7 of the fourth embodiment has constant permeability along the channel length. Since the gas mass flow fed via the covering surface increases in the direction of the outlet cross-section also in the case of constant permeability of the covering surface, acceleration of the flow in the direction of running of the strip 33 of carrier material takes place.

It is of course also possible that the gas/air-permeable channel-covering surface 7 built up from filter mats 26 does not extend horizontally, that is to say parallel to the channel base surface 3, but is inclined relative the channel base surface 3 in the same way as in the first and second embodiments of the drying device according to the invention. The channel-covering surface 7 can also comprise lined-up filter mats of the same structure and the same consistency, but different thicknesses, in which case the thickness of the filter mats decreases in the direction of running of the strip 33 of carrier material, that is to say, in other words, the permeability of the filter mats increases in the direction of the channel outlet.

The filter or the filter mats are commercially available so-called laminar continuous-flow filters, such as are used, for example, in the fresh air filter installations of clean rooms. Filter elements of this type, on the one hand, filter dirt particles out of the gas/air stream and, on the other hand, ensure very uniform laminar flow through the individual filter elements into the drying channel.

Figure 6:
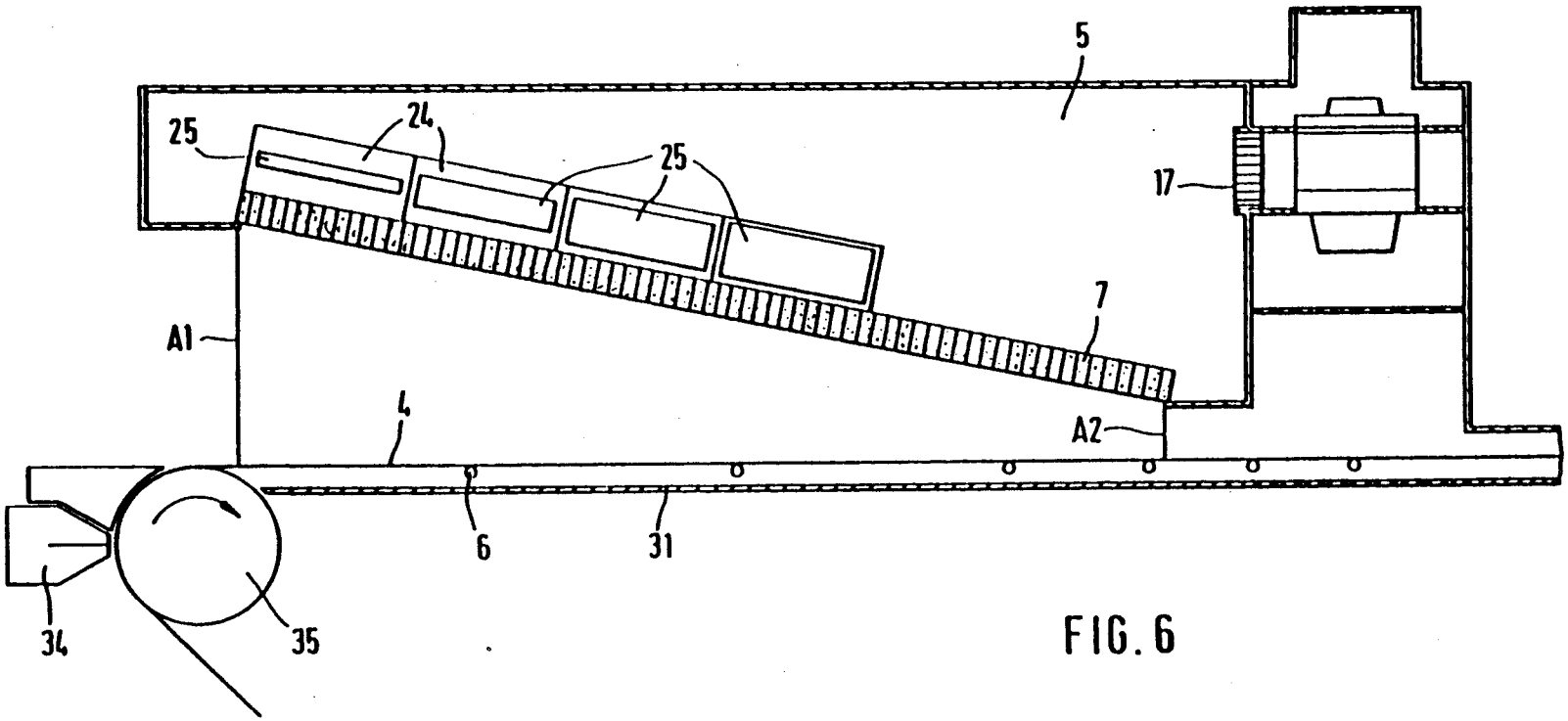
FIG. 6 shows a fifth embodiment of the drying device according to the invention, in section.

FIG. 6 shows a fifth embodiment of the drying device according to the invention, in section, wherein the channel-covering surface 7 is inclined relative to the horizontal channel base surface 3. The channel-covering surface is gas/air-permeable and comprises a continuous filter, but can also be made of lined-up filter mats, such as are shown in FIG. 5A. Above the channel-covering surface 7, there are feeding devices 24 which contain lamellae 25 which are adjustable relative to one another. The individual lamella lies parallel to the channel-covering surface 7 and is adjustable along its longitudinal axis. The arrangement of the lamellae 25 and their adjustability is approximately comparable to sun blinds built up from blades and is indicated in FIG. 6, in which the lamellae 25 are shown parallel to the covering surface 7 near to the inlet cross-section $A_1$ and perpendicular thereto near to the outlet crosssection $A_2$.

The other components of the fifth embodiment are the same as the corresponding components of the first to third embodiments of the drying device, and their description is therefore not repeated.

Figure 7:
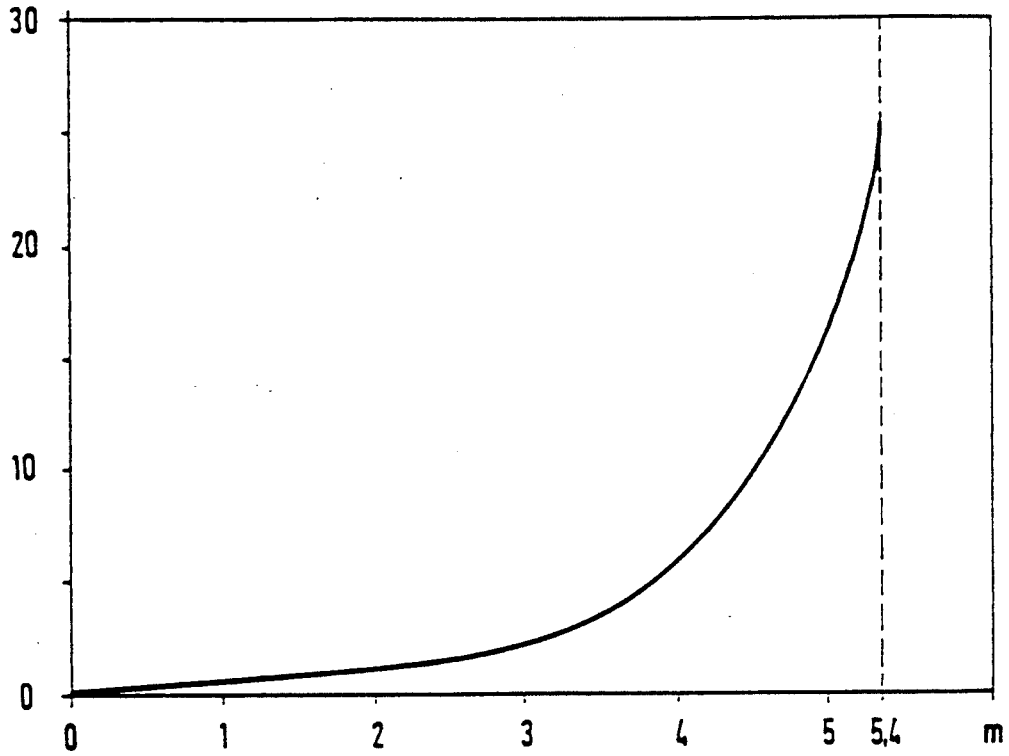
FIG. 7 shows a velocity profile of the gas flow as a function of the channel length of the drying channel.
Figure 8:
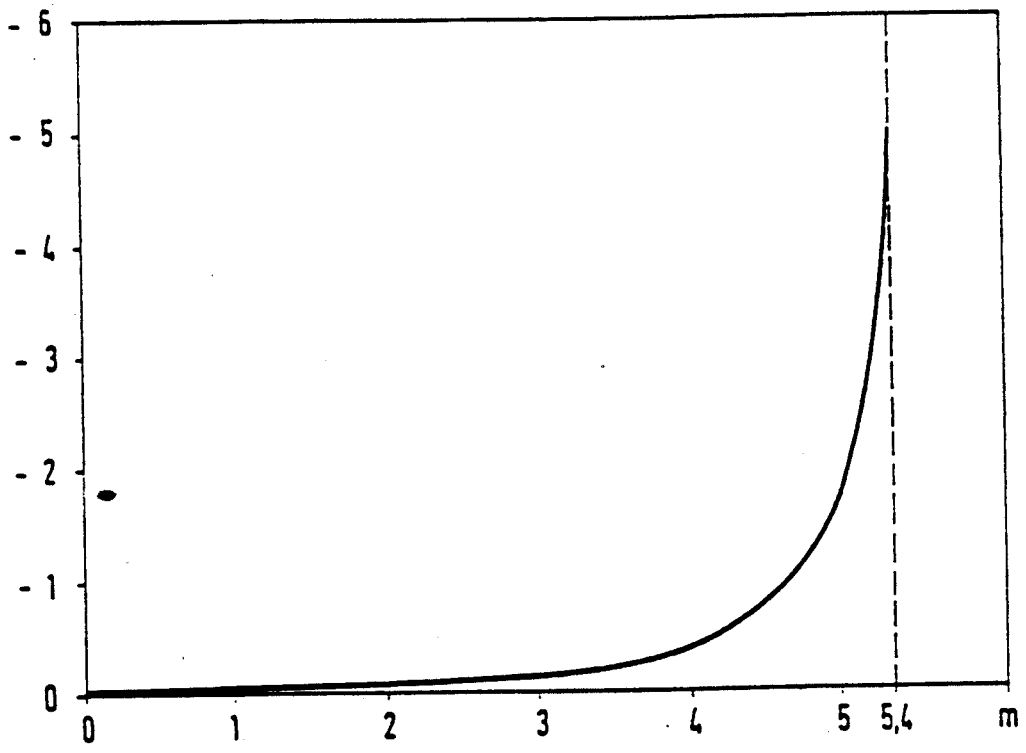
FIG. 8 shows a pressure profile, namely the static vacuum of the gas flow relative to atmospheric pressure, as a function of the channel length of the drying channel.

FIGS. 7 and 8 show, respectively, a velocity profile of the gas/air flow and a pressure profile, namely the static vacuum of the flow relative to atmospheric pressure, in each case as a function of the channel length of the drying channel. The curve of the velocity profile very closely resembles the curve of the pressure profile along the channel length. Up to the middle of the channel length, which is about 5.4 m in the present case, the velocity of the flow and the vacuum increase approximately linearly with the channel length, whereas a strong exponential rise of these parameters occurs in the second half of the drying channel.

Figure 9:
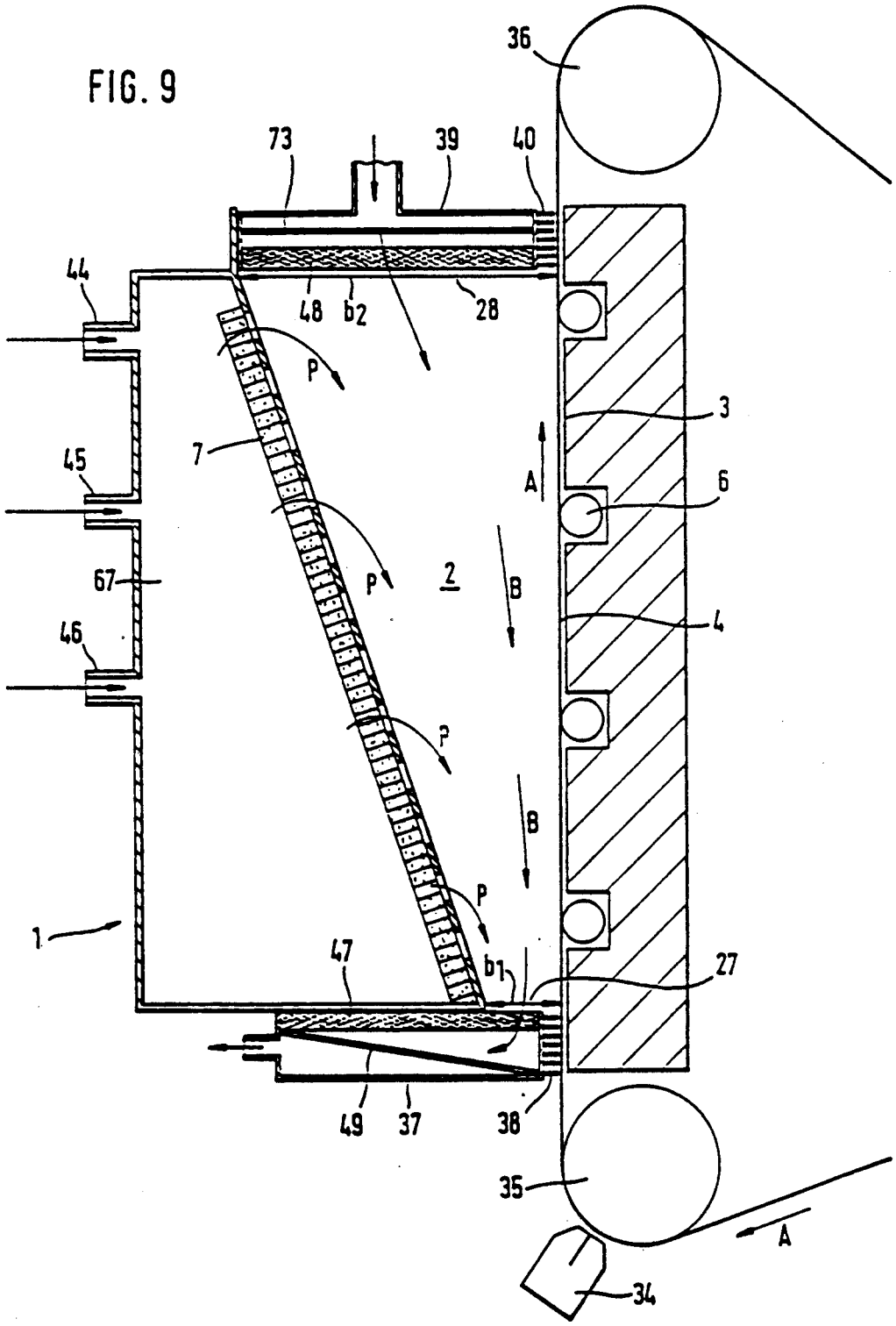
FIG. 9 shows a sectional view of a sixth embodiment of the drying device for one-sided drying of the carrier material, according to the invention.

In FIG. 9, a sixth embodiment of the drying device 1 according to the invention is shown in a diagrammatic sectional view. The strip 4 of carrier material, for example a metal strip of aluminum or a film strip, runs past the slot coater 34, which applies to the strip 4 of carrier material a liquid layer which contains vaporizable solvent components and non-vaporizable components. The strip 4 of carrier material is guided around the deflection roller 35 and runs vertically upwards through a channel inlet 27, having a channel inlet width b1, into the drying channel 2. The strip 4 of carrier material here runs in the drying channel 2 on support rollers 6 which are sunk into the vertical channel base surface 3 or are let into the channel bottom. The drying device 1 can also be designed as a drier in which the strip 4 of carrier material is passed through in free suspension by means of air supporting nozzles. In the channel inlet region, the strip of carrier material can also be passed through in contact with the channel bottom by means of vacuum and then through the drying channel 2 over supporting rollers.

The channel-covering surface 7 is designed as a gas-permeable surface which is inclined relative to the vertically extending channel base surface 3, the channel inlet width b1 of the channel inlet 27 of the drying channel 2 being smaller than the channel outlet width b2 of the channel outlet 28. The channel-covering surface 7 extends, for example, over the entire length of the drying channel 2, starting at the channel inlet 27.

The channel-covering surface 7 comprises a continuous filter of constant permeability. The cross-sections of the drying channel 2 are rectangular, the channel width increasing linearly upwards from the channel inlet 27 to the channel outlet width b2. An air chamber 67 of the drying device 1 is located to the side of the drying channel 2. In the vertical side wall of the air chamber 67, inflow channels 44, 45, 46 are located, through which drying gas, in particular heated air, flows in and enters the drying channel 2 through the channelcovering surface 7 in the direction of the arrows P. Towards the top, the channel outlet 28 of the drying channel 2 is closed by an inflow box 39 which has a filter mat 48 and through which drying gas flows downwards in the flow direction B, opposite to the running direction A of the strip 4 of carrier material, through the channel inlet 27 into a suction box 37 which closes the channel inlet towards the bottom. The suction box 37 is fitted with a filter mat 47 and a diagonally arranged, perforated impingement baffle 49 which prevents formation of eddies in the gas flow. The inflow box 39 can likewise be fitted with a perforated impingement baffle 73. The impingement baffle 49 can also be omitted if the filter mat 47 alone suffices to suppress formation of eddies. For the case that the gas flow entering via the channel outlet suffices alone for drying in the convergent drying channel 2, the channel-covering surface 7 can be made of impermeable material, and no drying gas is blown in through the side wall, so that the inflow channels in the vertical side wall of the drying device 1 can be omitted.

At the channel inlet 27 and at the channel outlet 28, the drying channel 2 is sealed as tightly as possible against the moving strip 4 of carrier material by means of lamellar seals 38 and 40 or labyrinth seals. The lamellar seals 38 and 40 are fitted to the vertical outer walls of the suction box 37 and inflow box 39, respectively, which face the strip 4 of carrier material. At the channel inlet 27 for the strip 4 of carrier material, the drying gas is drawn off through the suction box 37, an upward increase in the velocity of the gas flow, which suppresses turbulence, being produced in the drying channel 2, depending on the narrowing of the channel cross-section and the rate of the drying gas fed in or exhausted. The strip 4 of carrier material, emerging from the channel outlet 28, is guided by a deflection roller 36 from the vertical direction into a certain direction for further processing.

When the flow of the drying gas is opposite to the running direction A of the strip 4 of carrier material, it is found that the liquid layer on the strip 4 of carrier material dries without blow marks and without structure in the downward-converging drying channel 2. In this type of drying, the gas flow and the solvent vapors originating from the liquid layer follow gravity. The layer, dried in counter-current to the laminar, downward-accelerated gas stream, on the strip 4 of carrier material shows no blow marks which, under some circumstances are caused by solvent vapors detached due to gravity and dropping down. This can be shown by standstill tests, in which the strip 4 of carrier material provided with a liquid layer is stopped in the drying channel 2, and it is shown by means of flow test tubes that eddies of solvent vapors do not occur.

Figure 10:
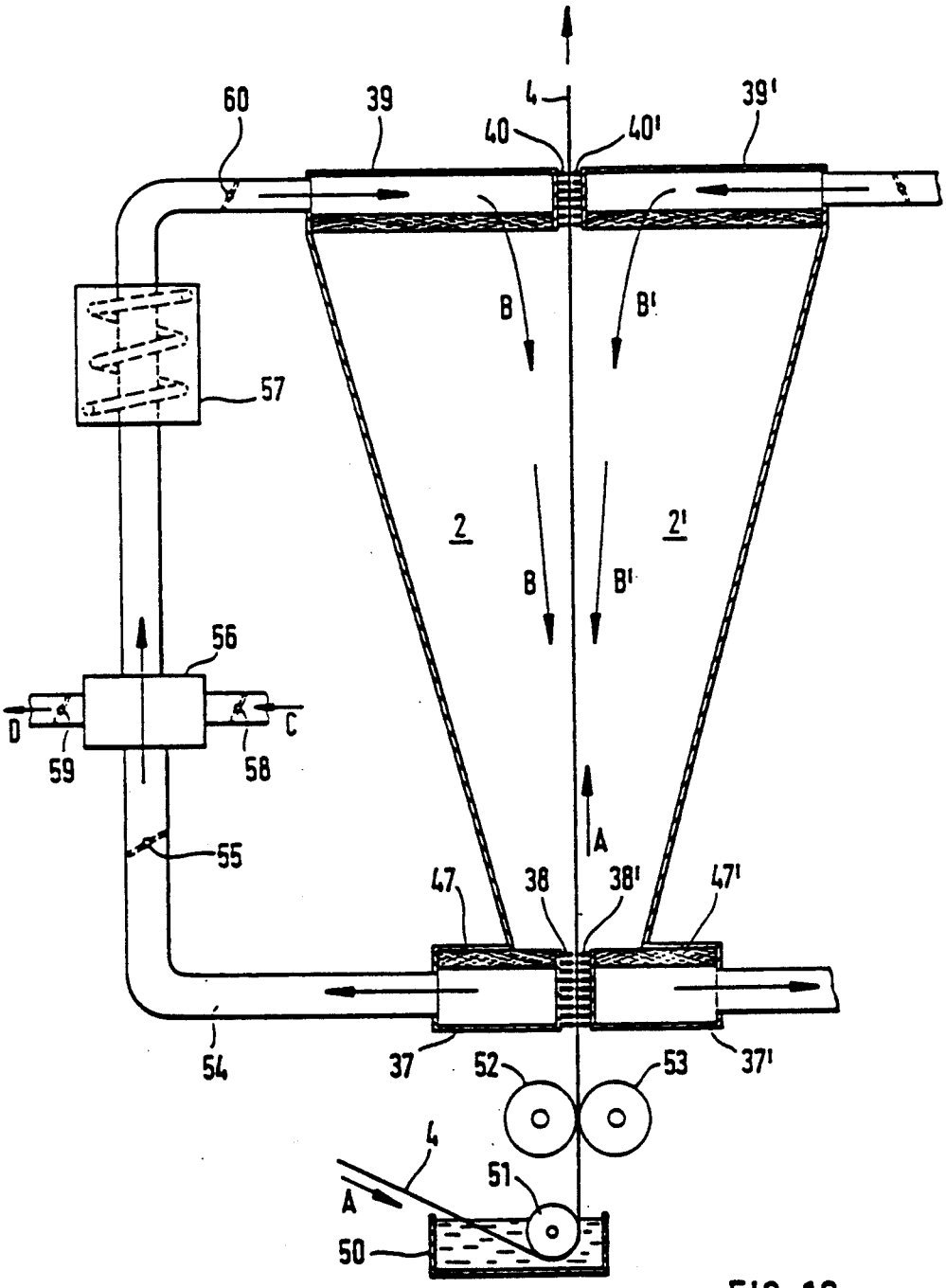
FIG. 10 shows a diagrammatic section view of a seventh embodiment of the drying device for two-sided drying of the carrier material, according to the invention, with two narrowing drying channels having a rectangular cross-section.

FIG. 10 shows a diagrammatic sectional view of a seventh embodiment of the drying device for two-sided drying of the strip 4 of carrier material, which carries a liquid layer on both sides, for example, and runs vertically upwards through the drying device. The two drying channels 2 and 2' are formed symmetrically to the vertical. In FIG. 10, the components which are located outside the drying channel 2 and are connected to the inflow box 39 and the suction box 37, are shown, whereas the same components, connected to the right-hand drying channel 2', were omitted in order to simplify the drawing.

The strip 4 of carrier material runs obliquely downwards into a vessel 50 containing the liquid, which is to be applied, of vaporizable solvent components and non-vaporizable components and is guided around a deflection roller 51 vertically upwards through the gap of squeeze rollers 52, 53 and between the suction boxes 37, 37' into the drying device.

In the vessel 50, the strip 4 of carrier material is coated on both sides with liquid, the excess of which is squeezed off in the gap between the squeeze rollers 52, 53. Of course, other known application processes can also be used for the two-sided coating of the strip 4 of carrier material. Within the drying device, the strip 4 of carrier material separates the two drying channels 2, 2' from one another and emerges between the two inflow boxes 39, 39' from the drying device. The drying gas is blown in via the filter mats or metal fabrics or the like of the inflow boxes 39, 39' into the drying channels 2, 2' vertically downwards in the flow directions B, B', opposite to the running direction A of the strip 4 of carrier material. The drying channel cross-sections narrow downwards, which results in an acceleration of the drying gas streams in the direction of the channel inlets. The drying gas is extracted through the filter mats or metal fabric of the suction boxes 37, 37', which close the channel inlets downwards. The drying gas exhausted through the left-hand suction box 37 flows through an air circulation line 54, in which a throttle flap 55 is provided, into a ventilation box 56. The ventilation box 56 has a fresh air feed line, in which a throttle flap 58 is mounted for controlling the fresh air rate fed in. The fresh air flows in flow direction C into the ventilation box 56. Furthermore, an exit air line, in which the spent air is discharged in flow direction D, is fitted to the ventilation box 56. In this exit air line, there is a throttle flap 59 for controlling the rate of discharged air.

From the ventilation box 56, the air circulation line passes through a heat exchanger 57, in which the air flowing in the air circulation line is heated, before it enters the inflow box 39 via a throttle flap 60.

The air flowing out of the drying channel 2' via the suction box 37, circulates in the same way as described above through the components, not shown, for reprocessing the circulating air and is returned via the inflow box 39, to the drying channel 2'.

In FIG. 11A, the region of the channel inlet 27 of a further embodiment of the invention is shown in detail. This embodiment substantially corresponds to the embodiment according to FIG. 9, with the difference that the strip 4 of carrier material does not run over rollers sunk into the channel base surface, but the back of the strip 4 of carrier material is subjected to vacuum in the suction region of the channel inlet, whereby it is ensured that the strip of carrier material is not deflected by the gas flow generated on the upper side. The drying gas flow is here opposite to the vertically upward-pointing running direction of the strip 4 of carrier material. In the suction region, there is a vacuum chamber 41 which is open, for example by means of a porous plate 42, towards the rear of the strip 4 of carrier material. In the interior of the vacuum chamber, a perforated metal sheet 68 is provided which ensures uniform outflow of the exhausted gas or of the exhausted air. The channel inlet 27 is, in the same way as in the case of the embodiment according to FIG. 9, closed downwards by a suction box 37. The gas flow accelerated in the flow direction B enters the interior of the suction box 37, in which a diagonally arranged, perforated impingement baffle 49 can also be present, through a filter mat 47, a metal fabric or the like. This impingement baffle is not absolutely essential and can also be omitted if there is no formation of eddies inside the suction box 37. The purpose of the impingement baffle 49 is, namely, to prevent the formation of eddies inside the suction box 37, so that exhaustion which is uniform across the entire drier width is ensured. On the vertical outside of the suction box 37, facing the front of the strip 4 of carrier material a lamellar seal 38 or a labyrinth seal is provided, which seals the channel inlet as tightly as possible, but without contact, from the moving strip 4 of carrier material. In the same way as in the case of the embodiment according to FIG. 9, drying gas or drying air is fed into the interior of the drying channel through the inclined channel-covering surface 7.

In FIG. 11B, the suction region of an embodiment is shown which largely corresponds to the embodiment according to FIG. 11A, with the sole difference that, in place of the lamellar seal, a blade seal 43 is fitted to the vertical outside of the suction box 37 and seals the channel inlet as tightly as possible from the strip 4 of carrier material. On the back of the strip 4 of carrier material, there is again a vacuum chamber 41, which prevents deflection of the strip 4 of carrier material by the gas flow generated on the top side.

FIG. 12A shows a diagrammatic sectional view of an eighth embodiment of the drying device 1, wherein the drying channel 2 has a vertically extending channel-covering surface 7, which runs parallel to the vertical channel base surface 3. The channel-covering surface 7 comprises lined-up filter mats 26 which have the same thickness and different permeabilities for a gas or air. In FIG. 12A, the different permeability is indicated by varying density of the hatching of the individual filter mats 26, in such a way that the filter mat near the channel outlet is hatched more densely, corresponding to its lower permeability, and the hatchings of the filter mats 26 decrease in the direction of the channel inlet, in order to indicate that the permeability of the filter mats increases opposite to the running direction A of the strip 33 of carrier material. The other components of the drying device, which are the same as the components of the embodiments of the drying device according to FIGS. 9 and 11A, are marked by the same reference numerals as in FIGS. 9 and 11A. Upstream of the channel inlet 27 of the drying channel 2, there is a suction box 37 with a filter mat 47. The channel cross-sections are constant along the length of the drying channel 2. Because of the different permeabilities of the filter mats 26, however, a different gas/air rate flows through each individual filter mat 26, which is indicated by the size of the bent arrows $P_1$ to $P_4$ which are allocated to the individual filter mats 26. Air or gas flows from above into the drying channel 2 via the inflow box 39 with the filter mat 48. An acceleration of the flow opposite to the running direction of the strip 33 of carrier material results from the increase, taking place in the direction of the channel inlet, in the gas/air rate fed in. This acceleration or this increase in velocity of the flow towards the channel inlet is indicated by the velocity arrows $v_i$ which increase in size and are drawn in parallel to the strip 33 of carrier material. The lateral feed of drying gas or air through the channel-covering surface 7 takes place via inflow channels 61 of the drying device 1.

With the exception of the covering surface, the ninth embodiment shown in FIG. 12B is the same as the eighth embodiment. The covering surface 7 of the ninth embodiment has constant permeability along the channel length. Since the gas mass flow fed via the covering surface increases in the direction of the channel inlet even at constant permeability of the covering surface, acceleration of the flow opposite to the running direction of the strip 33 of carrier material takes place.

The inflow and suction boxes are sealed by means of labyrinth seals 40 and 38, respectively, from the strip 33 of carrier material, and a vacuum chamber 41 ensures vacuum on the back of the strip 33 of carrier material in the region of the channel inlet, in order to prevent strip deflection on the front of the strip 33 by the flow.

The channel-covering surface 7 can also comprise lined-up filter mats of the same structure and same consistency, but different thicknesses, the thickness of the filter mats decreasing opposite to the running direction of the strip 33 of carrier material, that is to say, the permeability of the filter mats increases in the direction of the channel inlet.

Figure 13:
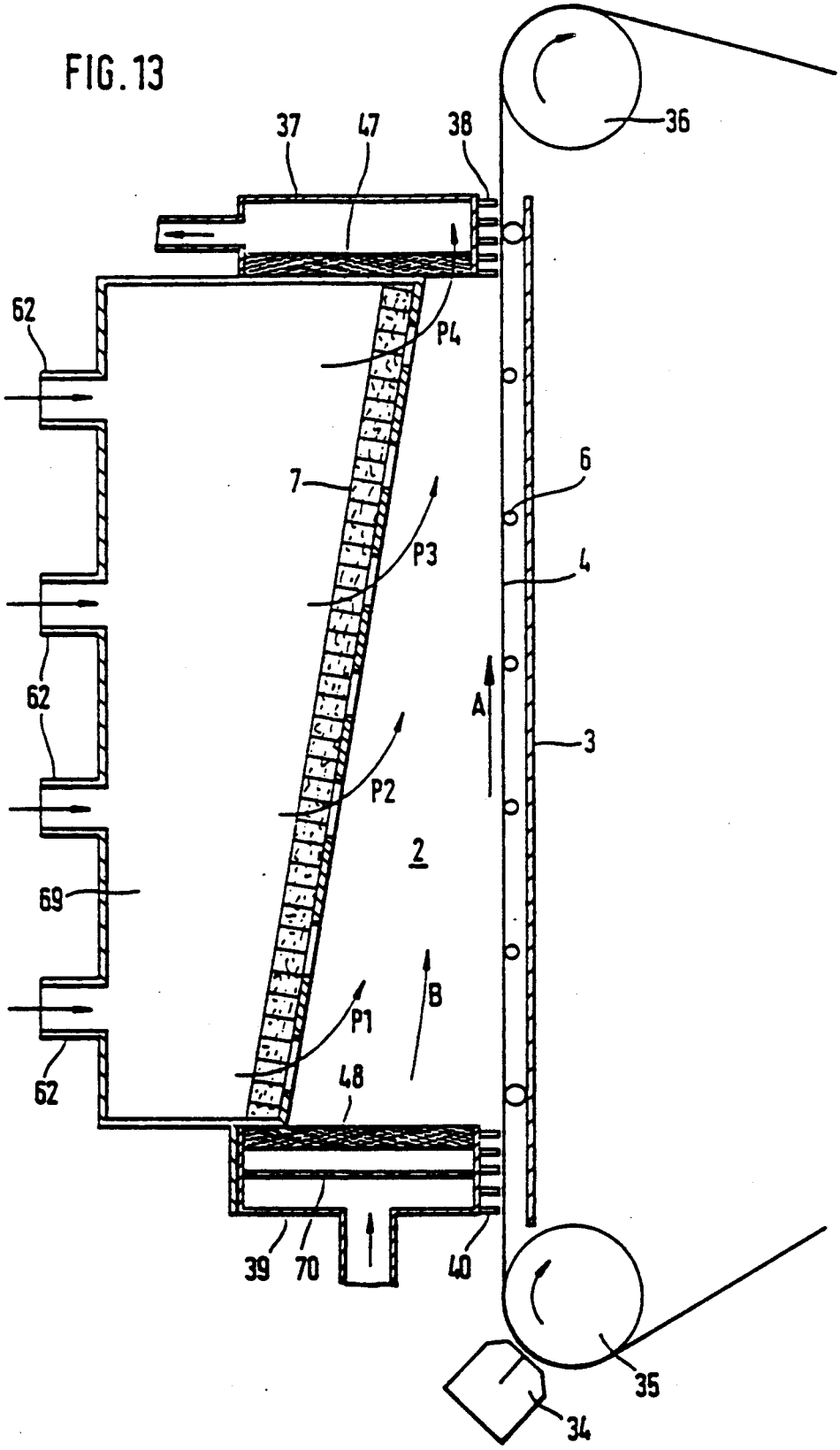
FIG. 13 shows a tenth embodiment of the drying device according to the invention, in section, with which the direction of running of the strip of carrier material and the direction of flow of the drying gas are the same.

FIG. 13 shows a tenth embodiment of the drying device according to the invention, in section, with which the channel-covering surface 7 converges towards the vertical channel base surface 3 in the direction of the channel outlet. The channel-covering surface 7 is gas/air-permeable and comprises a continuous filter, but can also be made of lined-up filter mats, such as are shown in FIG. 12A.

The channel inlet of the drying channel 2 is larger than the channel outlet. The cross-sections of the drying channel 2 are rectangular, the channel width decreasing linearly from the channel inlet upwards to the width of the channel outlet. An air chamber 69 of the drying device is located to the side of the drying channel. In the vertical side wall of the air chamber 69, inflow channels 62 are located, through which drying gas, for example heated air, flows in and enters the drying channel 2 through the channel-covering surface 7 in the direction of the arrows P1 to P4. The increasing size of the arrows P1 to P4 indicates that the flow of drying gas increases upwards inside the drying channel 2, in other words, that the flow velocity increases in the direction of the channel outlet.

The strip 4 of carrier material is guided around a deflection roller 35 which is located opposite to a slot coater34 in the 7 o'clock position, with a small gap. A liquid layer of vaporizable solvent components and non-vaporizable components is applied through the slot coater 34 to the front of the strip 4 of carrier material, which runs vertically upwards through the channel inlet into the drying channel 2. The strip 4 of carrier material here runs over supporting rollers 6 which are arranged laterally at a small distance from the channel base surface 3.

The channel inlet is closed by an inflow box 39 with a filter mat 48, and all or part of the drying gas flows through the inflow box 39 and the filter mat 48 upwards in flow direction B, co-current with the running direction A of the strip 4 of carrier material, through the drying channel 2.

The channel outlet is closed by a suction box 37 with a filter mat 47, through which the drying gas is exhausted.

At the channel inlet and channel outlet, the drying channel 2 is sealed by lamellar seals 40 and 38 respectively or by labyrinth seals as tightly as possible, but without touching, from the moving strip 4 of carrier material. The lamellar seals 38, 40 are located on the vertical outer walls of the suction box 37 or inflow box 39, respectively, which face the strip 4 of carrier material.

The strip 4 of carrier material leaving the channel outlet is conveyed over a deflection roller 36 and passed from the vertical direction into an obliquely downward-running direction for further processing.

The flow of drying gas co-current with the running direction A of the strip 4 of carrier material has the result that, at the channel inlet of the vertical drier, a laminar flow with a minimum velocity must be generated which prevents dropping down of the solvent vapors emerging from the liquid layer on the strip 4 of carrier material. In order to take along the solvent vapors in the running direction of the strip 4 of carrier material, the flow velocity at the channel inlet is set so high that the influence of gravity is overcome by the flow velocity of the drying gas. This is effected in such a way that, at the channel inlet of the drying gas, the drying gas already enters in laminar flow, as the result of appropriate measures on the inflow box 39, such as the fitting of the filter mat 48 and an perforated plate 70 in the interior of the inflow box. As a result, the solvent vapors can then be discharged upwards at the required velocity. This avoids the risk of the occurrence of blow structures on the coated front of the strip 4 of carrier material.

Figure 14:
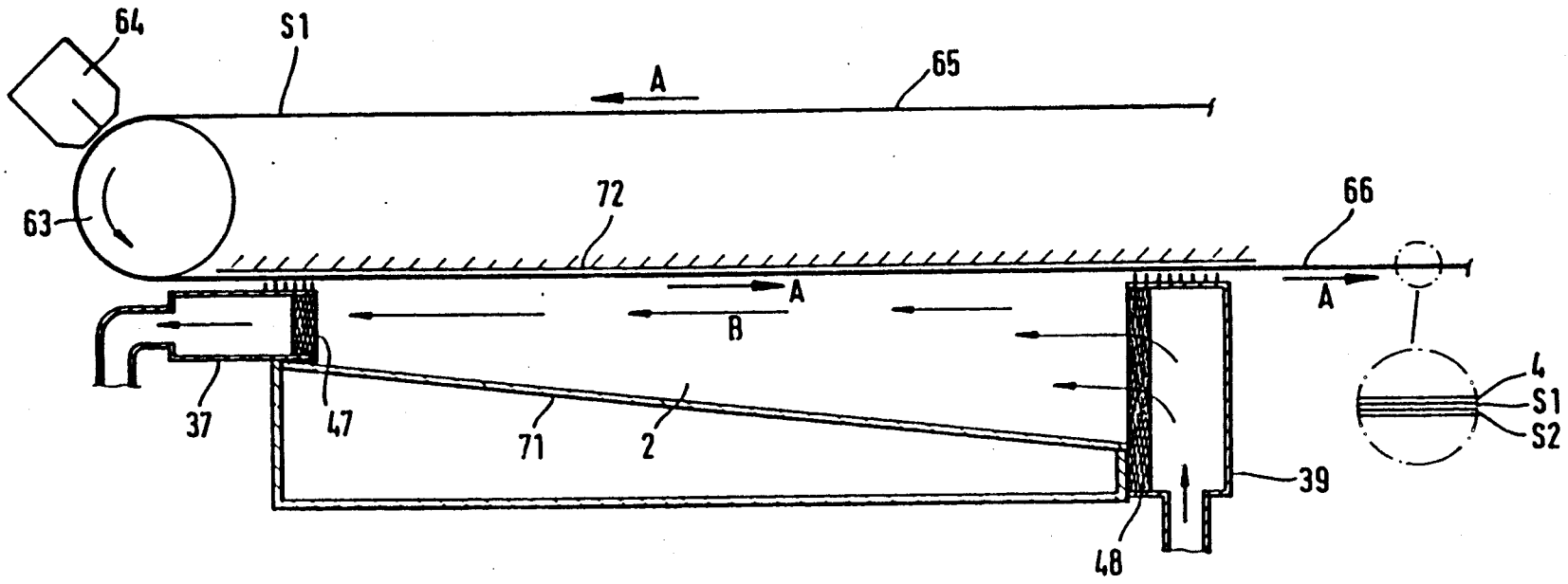
FIG. 14 shows a diagrammatic sectional view of an eleventh embodiment with horizontal passage of the lower section of the strip of carrier material, to which a downward-facing liquid layer has been applied.

In the eleventh embodiment of the invention according to FIG. 14, the drying channel 2, an upper section 65 and a lower section 66 of the strip 4 of carrier material extend horizontally. In this embodiment, the flow direction B of the drying gas, which flows into the drying channel 2 through the inflow box 39 and flows out through the suction box 37, is opposite to the running direction A of the lower section of the strip 4 of carrier material through the drying channel 2, and the flow is accelerated in the flow direction B.

This embodiment is used, for example, when a second layer S2 is applied to a dried first layer S1 on the strip 4 of carrier material. For example, the top side of the upper section 65 has already been provided with a dried first liquid layer and is passed around a deflection roller 63. A slot coater 64 is located in the 11 o'clock position and at a small distance from the deflection roller 63. The second liquid layer is applied through the slot coater 64 to the dried first liquid layer on the strip 4 of carrier material. The second liquid layer passes, suspended on the underside of the horizontally guided lower section 66, through the drying channel 2. The strip 4 of carrier material is guided underneath and along a horizontal channel cover 72 of the drying channel 2. A channel bottom 71 of the drying channel 2 converges in the flow direction B of the drying gas. The channel inlet of the drying channel 2 for the strip 4 of carrier material has a smaller height than the channel outlet, which closes the vertically aligned inflow box 39 having a filter mat 48. The channel inlet is closed by the suction box 37 and the filter mat 47 thereof. Both the inflow and the suction box carry, on their horizontal top sides, labyrinth seals which seal the channel outlet and the channel inlet from the lower section 66 of the strip 4 of carrier material.

In its arrangement and mode of action, this embodiment of the drying channel is comparable with the right-hand half of the embodiment according to FIG. 10, if it is taken into account that the drying channel 2 is arranged horizontally and not vertically as in the embodiment according to FIG. 10, and that it is the application and drying of a second layer on a first layer of the strip of carrier material which is concerned.

Below, three illustrative examples and two comparison examples of webs of carrier material are given, to which liquid layers which have to be dried have been applied.

ILLUSTRATIVE EXAMPLE 1

A solution of a light-sensitive polymer material in an organic solvent is applied uniformly by means of a suitable coating process to an aluminum web 4, pretreated for offset purposes, of 0.1 mm thickness at a running speed of the aluminum web 4 of 8 m/minute.The solution has a dynamic viscosity of 1.4 mPas, and the thickness of the liquid film is 27 $\mu$m.

Immediately after the slot coater 34, the aluminum web runs into a drying device 1 according to one of the embodiments according to FIGS. 1 to 4 or 6. The channel outlet height h2 in the channel outlet is 2 cm, and the channel inlet height h1 in the channel inlet is 30 cm. With a total length of the drying channel 2 of 1.2 m, the channel-covering surface 7 is inclined relative to the plane of the web at an angle of 13.1°. The air circulation fan 12 has not been switched on and the throttle flap 13 is closed. The output of the suction fan 9 is adjusted such that an air velocity $v_1$ equal to 0.3 m/second prevails at the inlet of the drying channel 2. This results in an air velocity $v_2$ equal to 4.5 m/second in the outlet cross-section A2 of the drying channel. For complete removal of solvent residues from the almost dried liquid film on the aluminum web 4, a nozzle drier according to the state of the art is provided downstream, wherein the air flow is in general highly turbulent.

The resulting photo-sensitive layer of the aluminum web 4, which is then cut and converted into printing plates, is very uniform in its thickness and in its visual appearance. By means of a reflected-light densitometer, a uniform optical density of 1.47 is measured across the entire coated plate area.

COMPARISON EXAMPLE 1 (TO ILLUSTRATIVE EXAMPLE 1)

The experimental procedure corresponds more or less to that of illustrative example 1, but the suction fan 9 in the drying device 1 is not switched on, so that the coated aluminum web 4 is only slightly dried incipiently by evaporation of a small part of the solvents, when it passes through the first drying region. The actual drying of the liquid film takes place in the downstream nozzle drier.

A layer having a cloudy or mottled structure is obtained. Thin and thick areas of a superficial extent of 5 to 20 mm diameter are here irregularly distributed across the total surface. The densitometric measurement does not give uniform optical density; rather, the latter fluctuates in its magnitude between 1.43 and 1.50, depending on the place of measurement.

ILLUSTRATIVE EXAMPLE 2

A vesicular film solution, dissolved in an organic solvent, is applied by means of a suitable coating process to a polyester film of 125 μm thickness. The coating speed is 5 m/minute. The solution has a dynamic viscosity of 5.5 mPas, and the thickness of the liquid film applied is 40 μm. The liquid film is dried in the same way as was described by reference to illustrative example 1.

For testing the uniformity of the layer, the film is irradiated in the printing frame with UV light over a large area and then developed by brief heating to 100° C. The resulting opacity of the film layer is uniform across the entire surface.

COMPARISON EXAMPLE 2 (TO ILLUSTRATIVE EXAMPLE 2)

The coating and the drying take place similarly as in illustrative example 2, except that the suction fan 9 in the drying device is not switched on. The actual drying of the liquid film takes place only in the downstream nozzle drier, as in comparison example 1.

After the UV exposure and thermal development at 120° C., a cloudy structure of the vesicular film on the polyester film is found in transmitted light. Thin and thick areas of 5 to 20 mm diameter are here distributed irregularly across the surface.

ILLUSTRATIVE EXAMPLE 3

A solution of a light-sensitive polymer material is uniformly applied at a strip speed of 15 m/minute to an aluminum web, pretreated for offset printing purposes, as the strip 4 of carrier material having a thickness of 0.3 mm.

The liquid film is 33 μm thick. The solution has a dynamic viscosity of 2.9 mPas.

A drying device 1 as shown in FIG. 2 is used. The channel inlet height h1 is 0.5 m and the channel outlet height h2=0.1 m. The channel-covering surface 7 is in the form of a porous filter and inclined at an angle of 4.3° relative to the aluminum web or the strip 4 of carrier material.

The air circulation fan 12 is in operation and the throttle flap 13 is open. The position of the further throttle flap 14 is selected such that a volumetric air flow of 1000 $m^3$/hour of fresh air is drawn into the drying chamber 5. An equal air rate is exhausted by the suction fan 9 from the drying channel 2, so that vaporized solvent cannot concentrate in the drying air. The result of the exact adjustment of the volumetric air flow at the suction fan 9 is that it operates at a velocity v2 of approximately 10 m/second and the inflow velocity v1 is almost zero. The channel length of the drying channel 2 is about 5.7 m.

No thick and thin areas are detectable on the aluminum web surface dried in this way. The optical density measured in reflection is constant across the entire surface.

In practice, channel lengths of the drying channels of from 10 to 12 m are used, the channel length and the volumetric flow of the drying gas depending, inter alia, on the passage speed of the strip of carrier material through the drying device.

What is claimed is:

1. A process for drying a liquid layer which has been applied to a carrier material moving through a drier comprising a drying zone and which contains vaporizable solvent components and nonvaporizable components, wherein a gas flows in the longitudinal direction of said carrier material parallel to said liquid layer and is accelerated within said drying zone in the direrction of flow, the inlet velocity of the gas flow is increased to a final velocity of up to about 1000 times said inlet velocity, and disturbances arising in the inlet cross-section and at the beginning of the drying zone, such as eddies and turbulence in said gas flow, are damped out, so that said gas flow becomes laminar within said drying zone.

2. The process as claimed in claim 1, wherein said gas flows in said same direction as or in the opposite direction to the running direction of said carrier material along and parallel to said liquid layer.

3. The process as claimed in claim 1, wherein the velocity distribution of said gas flow in the individual cross-sections of said drying zone transverse to the direction of running of said carrier material is constant.

4. The process as claimed in claim 1, wherein said gas is heated and the total gas stream is exhausted at one end of said drying zone.

5. The process as claimed in claim 1, wherein the flow through the drying zone takes place at a constant volumetric gas flow rate, the crosssection of said drying zone steadily decreasing in the direction of running of said carrier material.

6. The process as claimed in claim 1, wherein the volumetric gas flow rate is steadily increased in the direction of running of said carrier material, at constant cross-section of said drying zone.

7. The process as claimed in claim 1, wherein the volumetric gas flow rate is steadily increased in the direction of running of said carrier material, at decreasing cross-section of said drying zone.

8. The process as claimed in claim 2, wherein said carrier material runs vertically through said drying zone and one side of said carrier material carries a liquid layer which is dried.

9. The process as claimed in claim 8, wherein said carrier material is provided on both sides with liquid layers and both sides of said carrier material are dried by means of drying gas flowing in the direction opposite to the vertical direction of running of said carrier material.

10. The process as claimed in claim 2, wherein said carrier material with a liquid layer applied to its underside runs horizontally or obliquely through said drying zone and said drying gas flows underneath said carrier material along the suspended liquid layer.

11. The process as claimed in claim 2, wherein the flow through said drying zone takes place at a constant volumetric gas flow rate, the cross-section of said drying zone steadily decreasing opposite to the direction of running of said carrier material.

12. The process as claimed in claim 2, wherein the volumetric gas flow rate is steadily increased opposite to the direction of running of said carrier material, at constant cross-section of said drying zone.

13. The process as claimed in claim 2, wherein the volumetric gas flow rate is steadily increased opposite to the direction of running of said carrier material, at decreasing cross-section of said drying zone.

14. The process as claimed in claim 12, wherein said carrier material enters said drying zone at the bottom through the inlet of said drier and leaves said drying zone at the top through the outlet of said drier, and the downward-directed total gas stream is exhausted in the vicinity of said drier inlet.

15. A device for drying a liquid layer which has been applied to a moving carrier material and which contains vaporizable solvent components and nonvaporizable components, which comprises a drying channel through which said carrier material runs in the longitudinal direction, a horizontal channel base surface, and a channel-covering surface through which a stream of drying gas flows into said drying channel, wherein said channel-covering surface (a) is gas-permeable, the permeability of said surface being adjustable in the longitudinal direction of said drying channel, (b) is included relative to said channel base surface such that the channel inlet height of said drying channel is greater than the channel outlet height of said drying channel, and (c) extends over the entire length of said drying channel, starting at the channel inlet.

16. The device as claimed in claim 15, further comprising a drying chamber disposed above said drying channel, and a gas exchange chamber adjoining said drying channel which comprises a fan, the fan outlet of which is directed towards a heat exchanger which is disposed in a partition between said gas exchange chamber and said drying chamber.

17. The device as claimed in claim 16, wherein said gas exchange chamber has a bottom surface comprising a damper device and an upper gas inlet comprising a damper device.

18. The device as claimed in claim 16, wherein said fan is a double flow circulation fan with return blades, and fresh air added via said return blades is delivered into said drying chamber.

19. The device as claimed in claim 15, wherein the cross-sections of said drying channel are rectangular and the height of said channel decreases from said channel inlet height linearly to said channel outlet height.

20. The device as claimed in claim 15, wherein said drying channel has a trumpet-shaped geometry which tapers in the longitudinal direction and causes an acceleration of the gas stream in the direction of flow.

21. The device as claimed in claim 17, wherein said drying channel merges into a passage channel, the underside of the bottom surface of said gas exchange chamber is also the covering surface of said passage channel, and a suction fan, is provided downstream of said gas exchange chamber above the covering surface of said passage channel, the suction opening of which is located in the covering surface and in the outlet of which a damper device is arranged.

22. The device as claimed in claim 15, wherein a plurality of feeding devices for addition of said gas are provided on said top side of the channel-covering surface.

23. The device as claimed in claim 22, wherein at least one of said feeding devices comprises a box comprising two mutually displaceable orifice plates, the opening cross-sections of which are adjustable.

24. The device as claimed in claim 22, wherein at least one of said feeding devices comprises a plurality of mutually adjustable lamellae.

25. The device as claimed in claim 15, wherein said channel-covering surface forms a continuous gas-permeable filter.

26. The device as claimed in claim 15, wherein said channel-covering surface comprises a plurality of lined-up filter mats having the same thickness and the same or different permeability.

27. The device as claimed in claim 15, wherein said channel-covering surface comprises a plurality of lined-up filter mats of the same consistency and different thicknesses.

28. The device as claimed in claim 15, wherein said drying channel has a constant crosssection, the permeability of said channel-covering surface increasing in the longitudinal direction from a minimum value in the region of the channel inlet to a maximum value in the region of the channel outlet.

29. The device as claimed in claim 15, wherein a bottom surface or at least one side wall of said device just above said bottom surface has a plurality of openings for exhausting the gas layers present in the immediate vicinity of the side walls of said device.

30. The device as claimed in claim 16, further comprising a bottom surface which has, opposite said gas exchange chamber, an opening which is subjected to the same suction pressure as that prevailing in said gas exchange chamber.

31. The device as claimed in claim 15, wherein a sealing mat is located in front of the channel inlet of said drying channel.

32. The device as claimed in claim 15, wherein said channel-covering surface is inclined relative to a vertically extending channel base surface, the width of the channel inlet of the drying channel being smaller than the width of the channel outlet.

33. The device as claimed in claim 32, wherein the cross-sections of said drying channel are rectangular and the width of said channel increases from the channel inlet width upwards linearly to the channel outlet width.

34. The device as claimed in claim 32, wherein said drying channel has a geometry which narrows downwards in the shape of a trumpet and produces an acceleration of the gas stream flowing in at the top which increases vertically downward.

35. The device as claimed in claim 15, wherein said drying channel has a constant crosssection, the permeability of said channel-covering surface increasing in the vertical direction from a minimum value near the channel outlet to a maximum value near the channel inlet.

36. The device as claimed in claim 15, wherein the inlet gap into said channel inlet is bounded on one side by a lamellar seal, said lamellar seal being disposed, facing said moved carrier material, on the vertical outside of a suction box which closes said drying channel downwards, in the region of said channel inlet.

37. The device as claimed in claim 36, wherein a vacuum chamber, having a porous plate facing said carrier material, is arranged opposite said suction box on the other side of said carrier material.

38. The device as claimed in claim 15, wherein the inlet gap into said channel inlet is bounded on one side by a blade seal, said blade seal being disposed, facing said moved carrier material, on the vertical outside of a suction box.

39. The device as claimed in claim 36, wherein said channel outlet is bounded by a lamellar seal defining a gap between said moved carrier material and said seal, said lamellar seal being disposed, facing said carrier material, on the vertical outside of an inflow box which closes said drying channel upwards in the region of said channel outlet and through which said drying gas stream flows under pressure into said drying channel.

* * * * *